US006639493B2

(12) United States Patent
Shen et al.

(10) Patent No.: US 6,639,493 B2
(45) Date of Patent: Oct. 28, 2003

(54) MICRO MACHINED RF SWITCHES AND METHODS OF OPERATING THE SAME

(75) Inventors: Jun Shen, Phoenix, AZ (US); Meichun Ruan, Tempe, AZ (US)

(73) Assignee: Arizona State University, Tempe, AZ (US)

( * ) Notice: Subject to any disclaimer, the term of this patent is extended or adjusted under 35 U.S.C. 154(b) by 31 days.

(21) Appl. No.: 10/113,224

(22) Filed: Mar. 29, 2002

(65) Prior Publication Data

US 2003/0001704 A1 Jan. 2, 2003

Related U.S. Application Data

(63) Continuation-in-part of application No. 10/051,447, filed on Jan. 18, 2002.
(60) Provisional application No. 60/280,426, filed on Mar. 30, 2001.

(51) Int. Cl.[7] ..... H01H 51/22
(52) U.S. Cl. ..... 335/78; 200/181; 333/101
(58) Field of Search ..... 335/78–86, 128; 200/181; 257/414–418; 361/233, 234; 333/101–105

(56) References Cited

U.S. PATENT DOCUMENTS 4,570,139 A 2/1986 Kroll
6,016,092 A * 1/2000 Qiu et al. ..... 333/101
6,025,767 A * 2/2000 Kellam et al. ..... 335/128
6,115,231 A 9/2000 Shirakawa
6,124,650 A * 9/2000 Bishop et al. ..... 335/78
6,469,603 B1 * 10/2002 Ruan et al. ..... 335/78

FOREIGN PATENT DOCUMENTS

DE 100 31 569 A 2/2001
EP 0 709 911 A 5/1996
EP 0 887 879 A 12/1998

OTHER PUBLICATIONS

Ruana M et al; "Latching Microelectromagnetic Relays"; Technical Digest, Solid–State Sensor and Actuator Workshop, Hilton Head Island, SC USA; Jun. 4–8, 2000; Vo. A91, No. 3, pp. 346–350.
PCT International Search Report; PCT/US02/09905; Jul. 16, 2002; 4 pgs.

* cited by examiner

*Primary Examiner*—Tuyen T. Nguyen
(74) *Attorney, Agent, or Firm*—Ingrassia Fisher & Lorenz, PC

(57) ABSTRACT

A micro-machined radio frequency (RF) switch is described. The micro-machined RF switch includes a substrate, a moveable micro-machined cantilever supported by the substrate, and an actuation mechanism that causes the cantilever to switch between two or more states. In a first state, a conducting layer of the cantilever couples a RF transmission line to a reference signal. In a second state, the conducting layer does not couple the RF transmission line to the reference signal. In further states, the conducting layer can couple one or more additional RF transmission lines to respective reference signals. A portion of the cantilever can flex or be angled to enhance coupling of an RF transmission line to a reference signal.

56 Claims, 24 Drawing Sheets

FIG. 4A
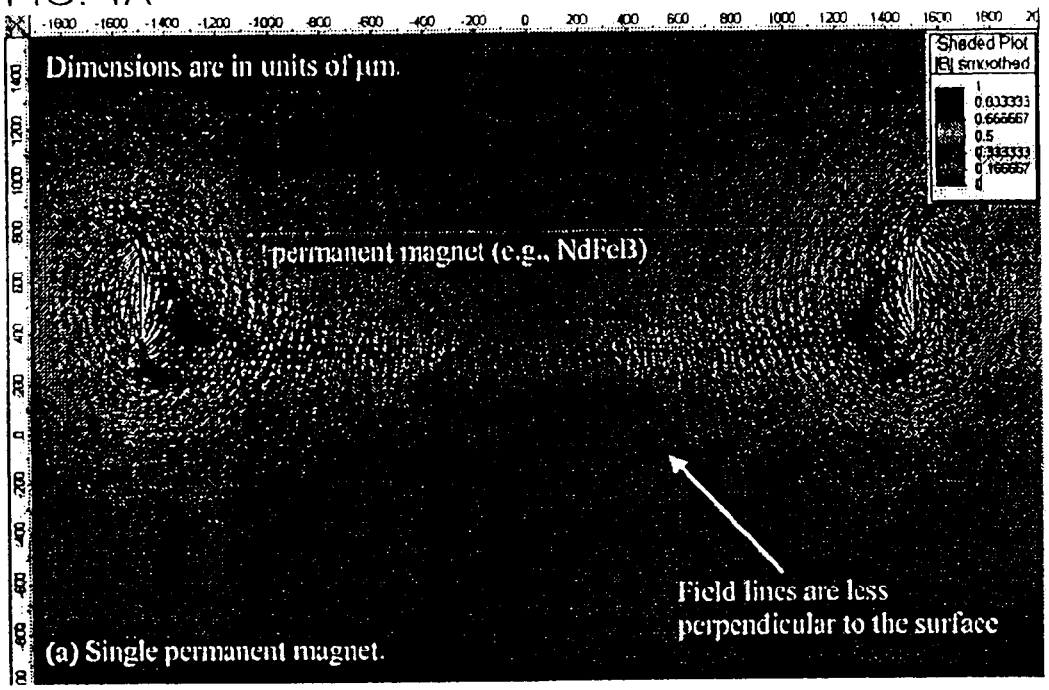
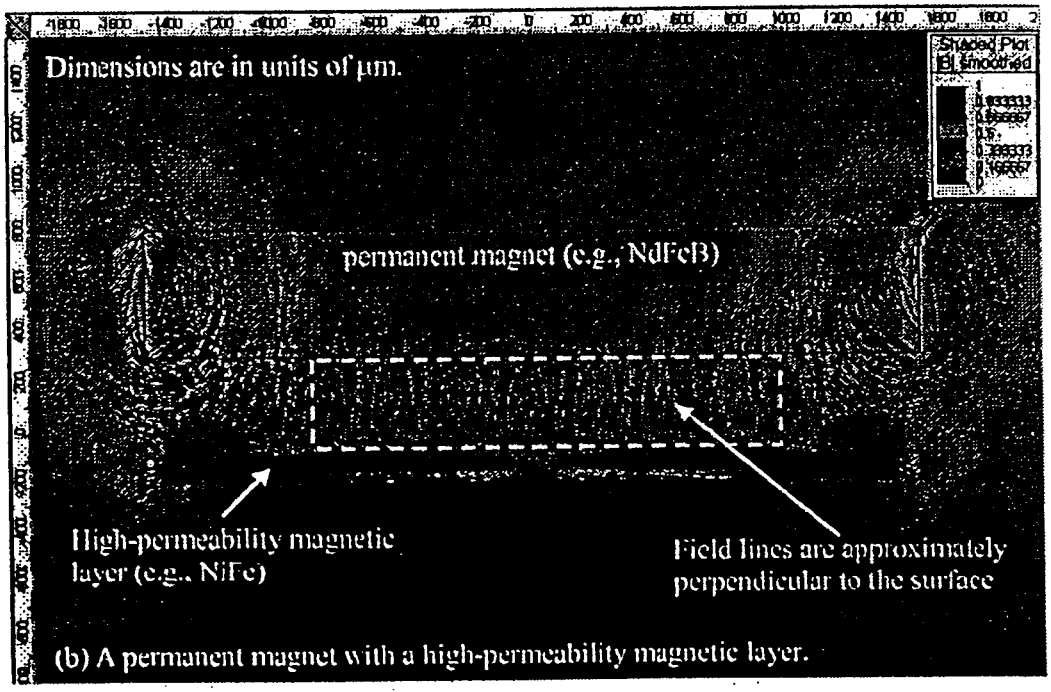
FIG. 4B

MICRO MACHINED RF SWITCHES AND METHODS OF OPERATING THE SAME

CROSS-REFERENCE TO RELATED APPLICATIONS

This application claims the benefit of U.S. Provisional Application No. 60/280,426, filed Mar. 30, 2001, which is herein incorporated by reference in its entirety.

This application is a continuation-in-part of application Ser. No. 10/051,447, filed Jan. 18, 2002, which is herein incorporated by reference in its entirety.

BACKGROUND OF THE INVENTION

1. Field of the Invention

The present invention relates to radio frequency (RF) switches. More specifically, the present invention relates to RF micro-magnetic latching switches with magnetic and electrostatic actuation mechanisms.

2. Related Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Another micro-magnetic relay is described in U.S. Pat. No. 5,847,631, (the '631 patent) issued to Taylor et al. on Dec. 8, 1998, the entirety of which is incorporated herein by reference. The relay disclosed in this patent includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

The basic elements of a micro-magnetic latching switch include a permanent magnet, a substrate, a coil, and a cantilever at least partially made of soft magnetic materials. In its optimal configuration, the permanent magnet produces a static magnetic field that is relatively perpendicular to the horizontal plane of the cantilever. However, the magnetic field lines produced by a permanent magnet with a typical regular shape (disk, square, etc.) are not necessarily perpendicular to a plane, especially at the edge of the magnet. Then, any horizontal component of the magnetic field due to the permanent magnet can either eliminate one of the bistable states, or greatly increase the current that is needed to switch the cantilever from one state to the other. Careful alignment of the permanent magnet relative to the cantilever so as to locate the cantilever in the right spot of the permanent magnet field (usually near the center) will permit bi-stability and minimize switching current. Nevertheless, high-volume production of the switch can become difficult and costly if the alignment error tolerance is small.

What is desired is a latching switch usable for RF signal applications. Such a switch should also be reliable, simple in design, low-cost and easy to manufacture, and should be useful in a variety of environments.

BRIEF SUMMARY OF THE INVENTION

Micro-machined RF switches having enhanced electrical and mechanical characteristics are described. The micro-machined RF switches include a substrate, a moveable micro-machined cantilever supported by the substrate, and an actuation mechanism that causes the cantilever to switch between two or more states. In one aspect, in a first state, a conducting layer of the cantilever couples a RF transmission line to a reference signal. In a second state, the conducting layer does not couple the RF transmission line to the reference signal. In further states, the conducting layer can couple one or more additional RF transmission lines to respective reference signals.

In a further aspect, the present invention is directed to a micro-machined RF switch with an electromagnetic actuation mechanism. A moveable micro-machined cantilever is supported by a substrate. The cantilever has a magnetic material and a longitudinal axis. The cantilever also has a conducting layer. A first permanent magnet produces a first magnetic field. The first magnetic field induces a magnetization in the magnetic material. The magnetization is characterized by a magnetization vector pointing in a direction along the longitudinal axis of the cantilever. The first magnetic field is approximately perpendicular to the longitudinal axis. An electromagnet produces a second magnetic field to switch the cantilever between a first stable state and a second stable state. A temporary current through the electromagnet produces the second magnetic field such that a component of the second magnetic field parallel to the longitudinal axis changes direction of the magnetization vector, thereby causing the movable element to switch between the first stable state and the second stable state. In the first stable state, the conducting layer couples a RF transmission line to a reference signal. In the second stable state, the conducting layer does not couple the RF transmission line to the reference signal.

In another aspect, the RF switch includes a torsion spring that supports the cantilever on the substrate. The torsion spring flexes to allow the cantilever to move.

In another aspect, in the second stable state, the conducting layer couples a second RF transmission line to a second reference signal.

In another aspect, in the first stable state, a first portion of the conducting layer connects the first RF transmission line to the first reference signal, and in the second stable state, a second portion of the conducting layer connects the second RF transmission line to the second reference signal.

In another aspect, a first portion of the cantilever flexes to enhance coupling of the first RF transmission line to the first reference signal by the conducting layer, and/or a second portion of the cantilever flexes to enhance coupling of the second RF transmission line to the second reference signal by the conducting layer.

In another aspect, the cantilever includes a first angled portion to enhance coupling of the first RF transmission line to the first reference signal by the conducting layer, and/or the cantilever includes a second angled portion to enhance coupling of the second RF transmission line to the second reference signal by the conducting layer.

In still another aspect, the present invention is directed to a micro-machined RF switch with an electrostatic actuation mechanism. A moveable micro-machined cantilever is supported by a substrate. The cantilever has a conducting layer. The cantilever is switchable to at least a first state and a second state. A gate metal is formed on a surface of the substrate proximate to the conducing layer. A voltage applied to the gate metal produces an electrostatic attraction between the gate metal and the conducting layer. The cantilever is thereby caused to switch to the first stable state. In the first state, the conducting layer couples a RF transmission line to a reference signal. In the second state, the reference signal is decoupled from the first RF transmission line.

In another aspect, a second gate metal is formed on a surface of the substrate proximate to the conducting layer, on a side of the torsion spring opposite the first gate metal. A voltage applied to the second gate metal produces an electrostatic attraction between the second gate metal and the conducting layer. The cantilever is thereby caused to switch to a third state. In the third state, the conducting layer couples a second RF transmission line to a second reference signal. In the second state, the conducting layer is decoupled from the first and second RF transmission lines.

In another aspect, a first portion of the cantilever flexes to enhance coupling of the first RF transmission line to the first reference signal by the conducting layer, and/or a second portion of the cantilever flexes to enhance coupling of the second RF transmission line to the second reference signal by the conducting layer.

In another aspect, the cantilever includes a first angled portion to enhance coupling of the first RF transmission line to the first reference signal by the conducting layer, and/or the cantilever includes a second angled portion to enhance coupling of the second RF transmission line to the second reference signal by the conducting layer.

The micro-magnetic latching switches of the present invention can be used in a plethora of products including household and industrial appliances, consumer electronics, military hardware, medical devices and vehicles of all types, just to name a few broad categories of goods. The micro-magnetic latching switches of the present invention have the advantages of compactness, simplicity of fabrication, and have good performance at high frequencies, which lends them to many novel applications in many RF applications.

These and other objects, advantages and features will become readily apparent in view of the following detailed description of the invention.

BRIEF DESCRIPTION OF THE DRAWINGS/ FIGURES

The accompanying drawings, which are incorporated herein and form a part of the specification, illustrate the present invention and, together with the description, further serve to explain the principles of the invention and to enable a person skilled in the pertinent art to make and use the invention.

FIGS. 4A–B show the computer simulation of magnetic flux distributions, according to the present invention.

Figure 5A:
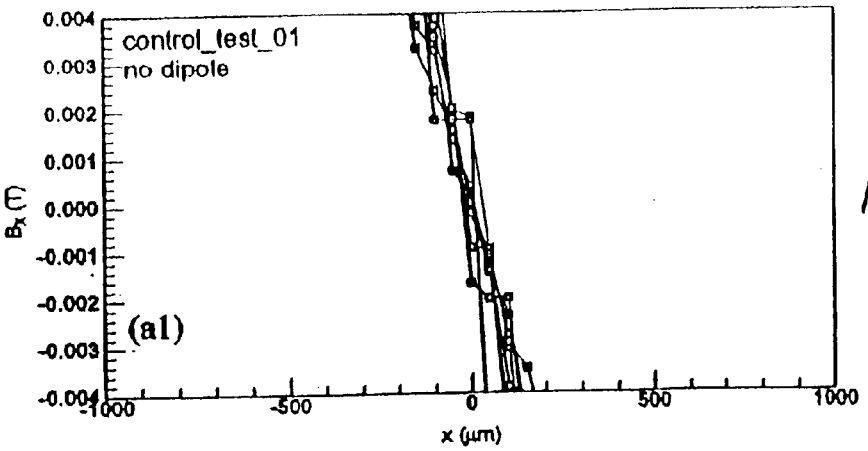
Figure 5B:
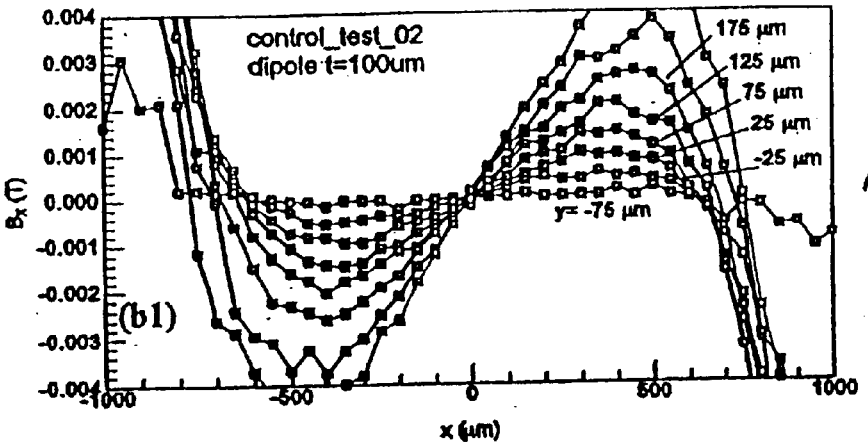
Figure 5C:
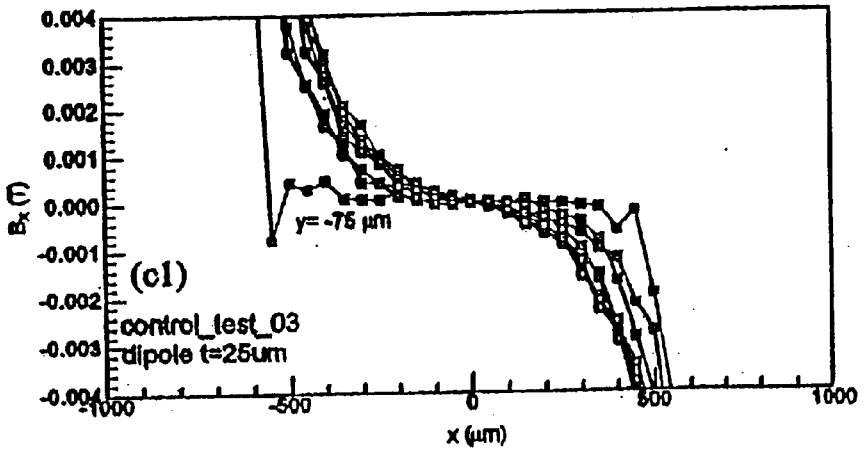

FIGS. 5A–C show extracted horizontal components (Bx) of the magnetic flux in FIGS. 4A–B.

Figure 6A:
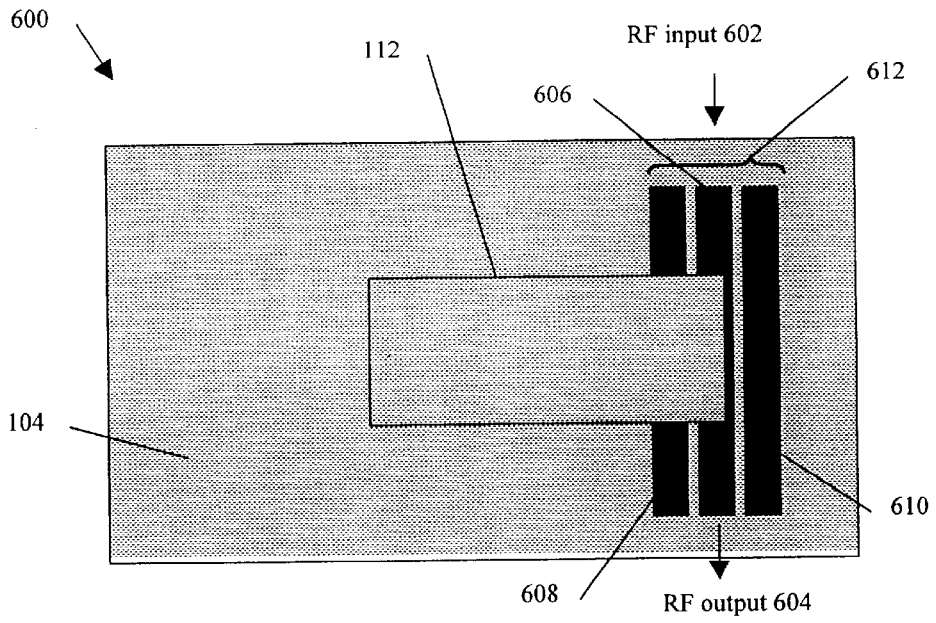
Figure 6B:
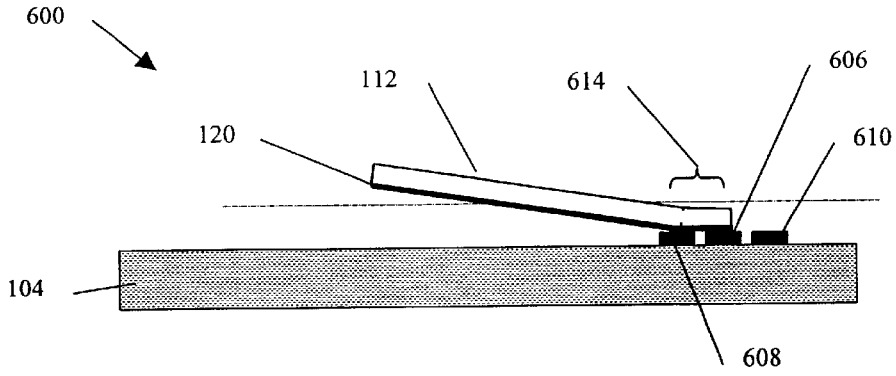
Figure 6C:
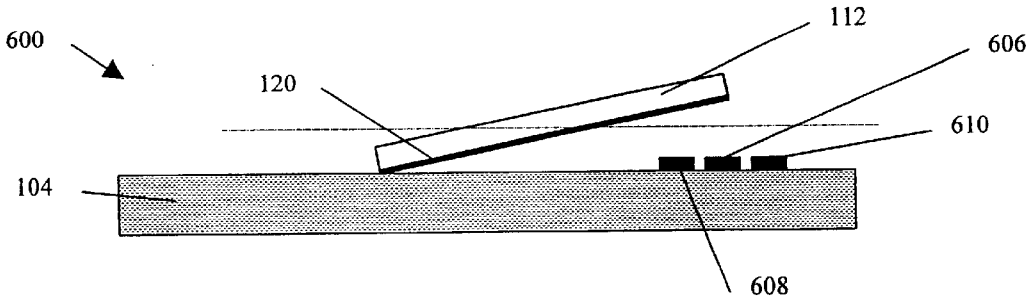

FIGS. 6A–6C show high level views of the micro-machined RF switch, according to embodiments of the present invention.

Figure 7A:
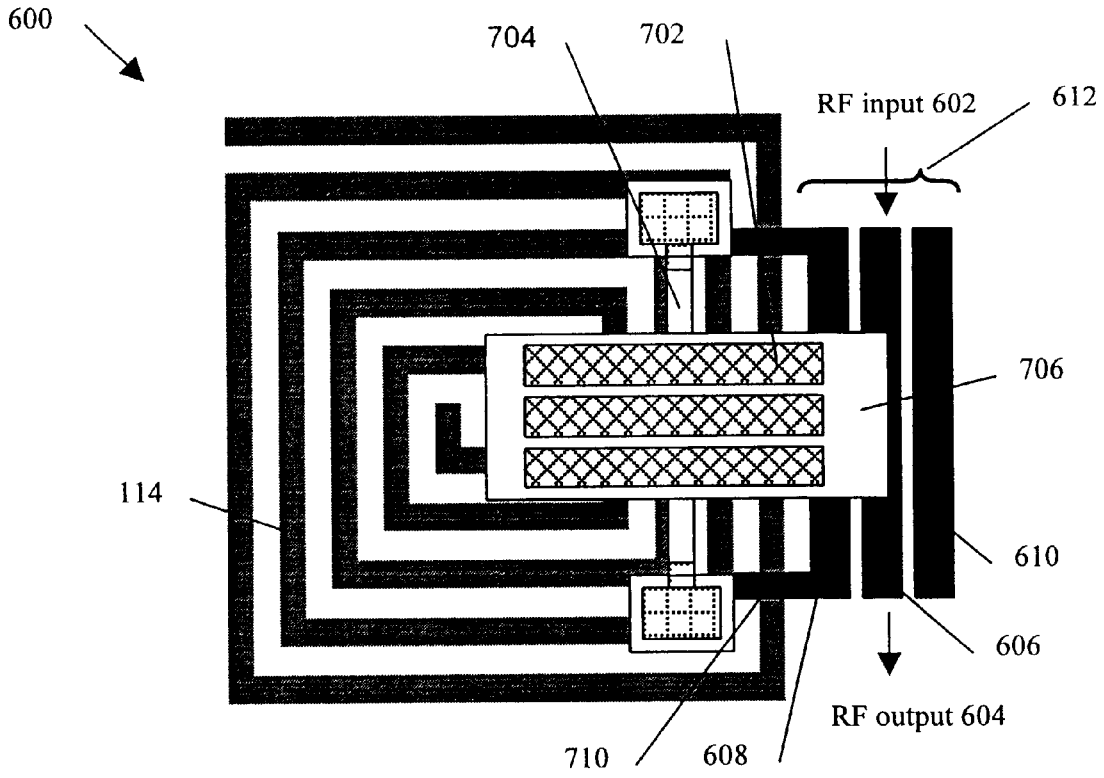
Figure 7B:
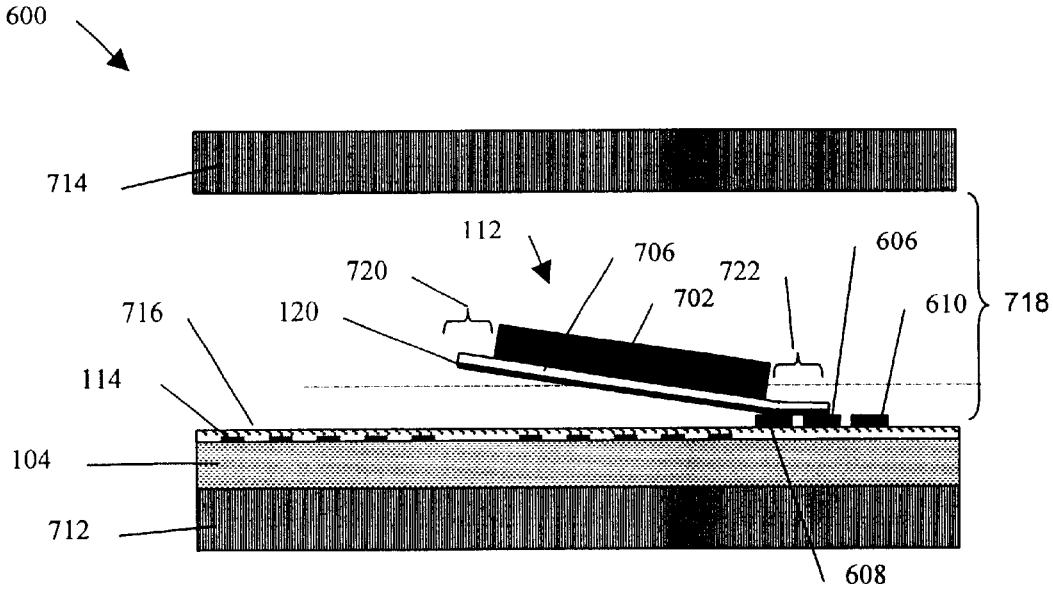
Figure 7C:
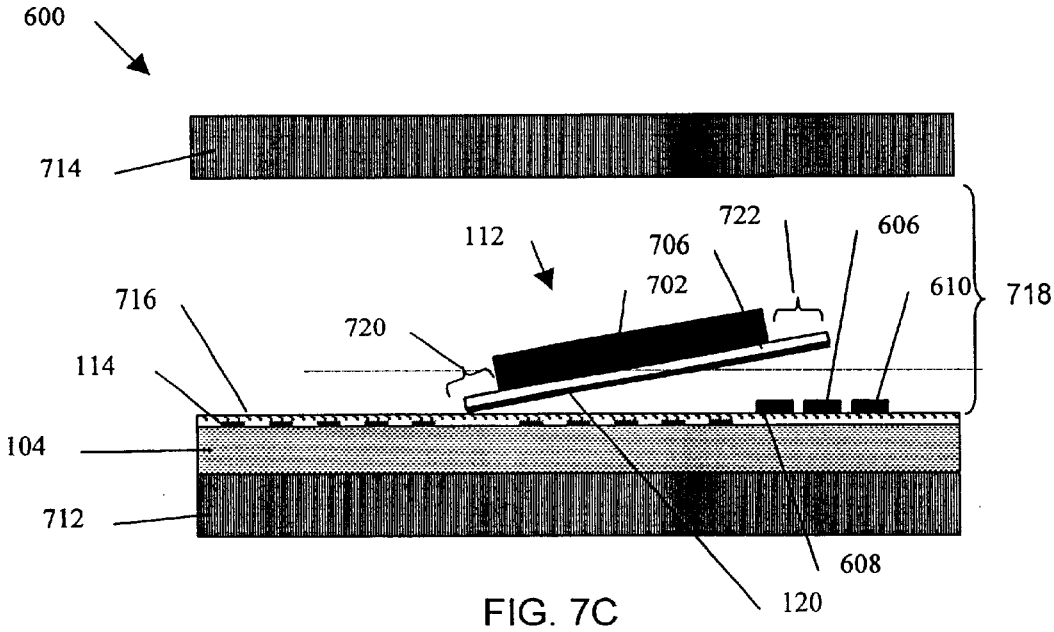

FIGS. 7A–7C illustrate detailed views of a micro-machined RF switch with an electromagnetic actuation mechanism, according to an embodiment of the present invention.

Figure 8A:
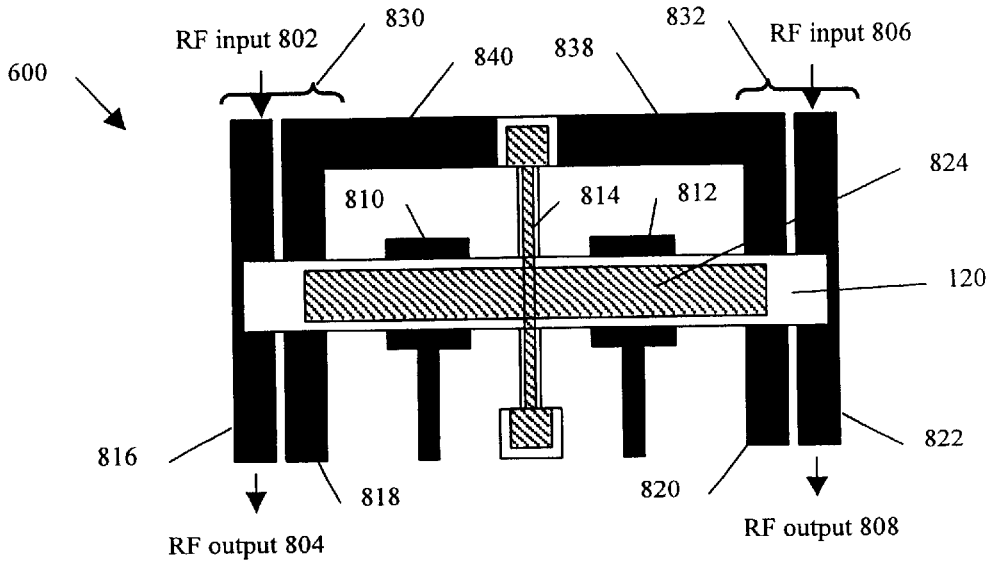
Figure 8B:
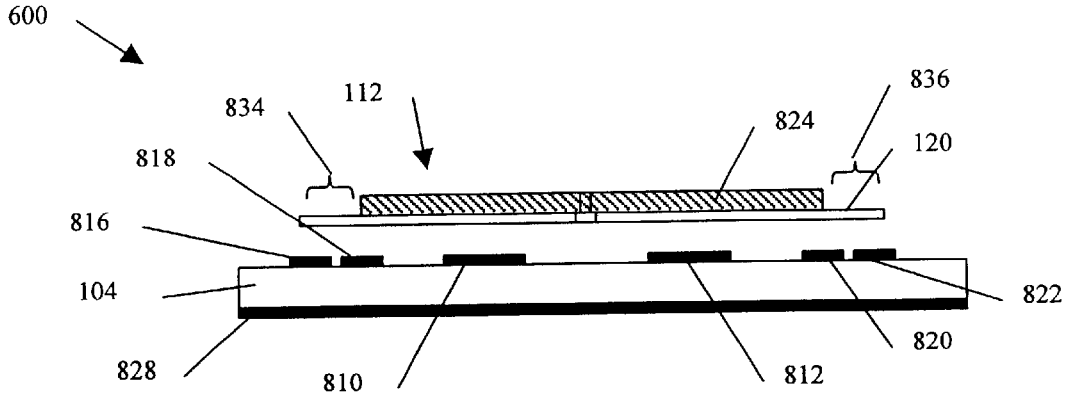
Figure 8C:
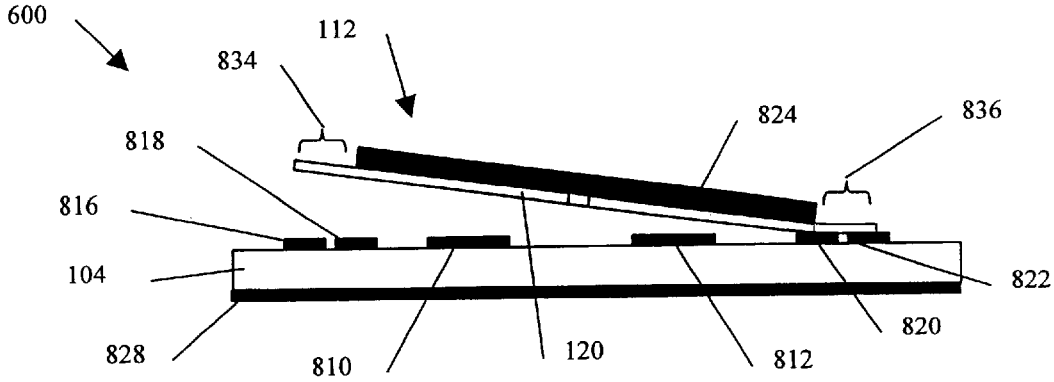

FIGS. 8A–8C illustrate detailed views of a micro-machined RF switch with an electrostatic actuation mechanism, according to an embodiment of the present invention.

Figure 9A:
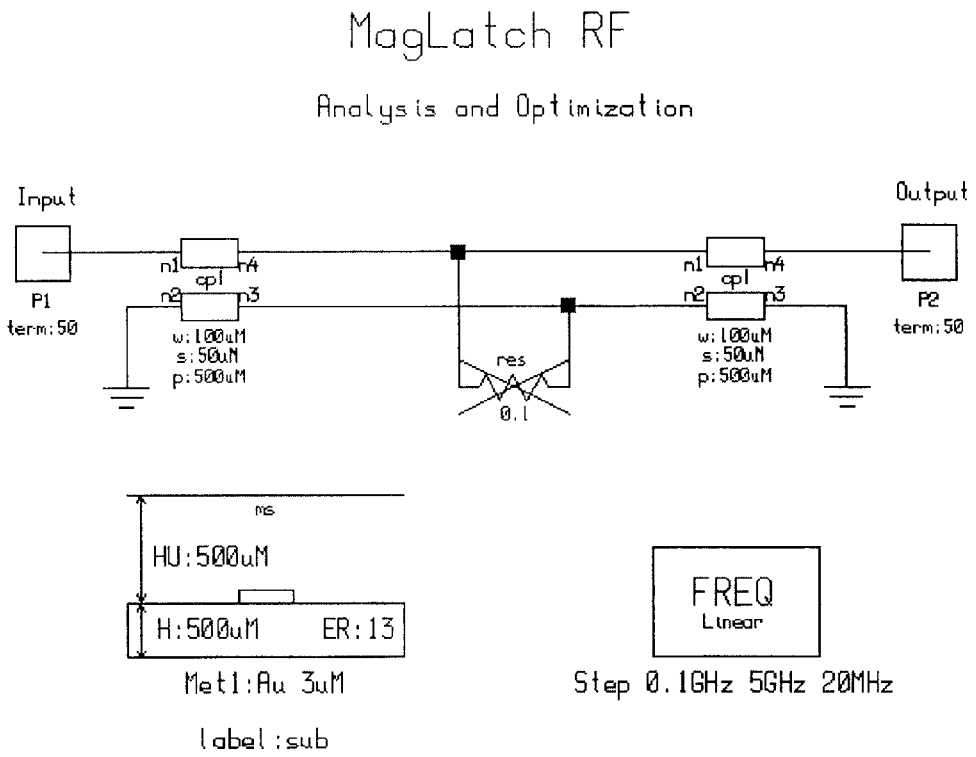

FIG. 9A illustrates an example micro-machined RF switch schematic equivalent circuit diagram, which is in the "ON" state, according to the present invention.

Figure 9B:
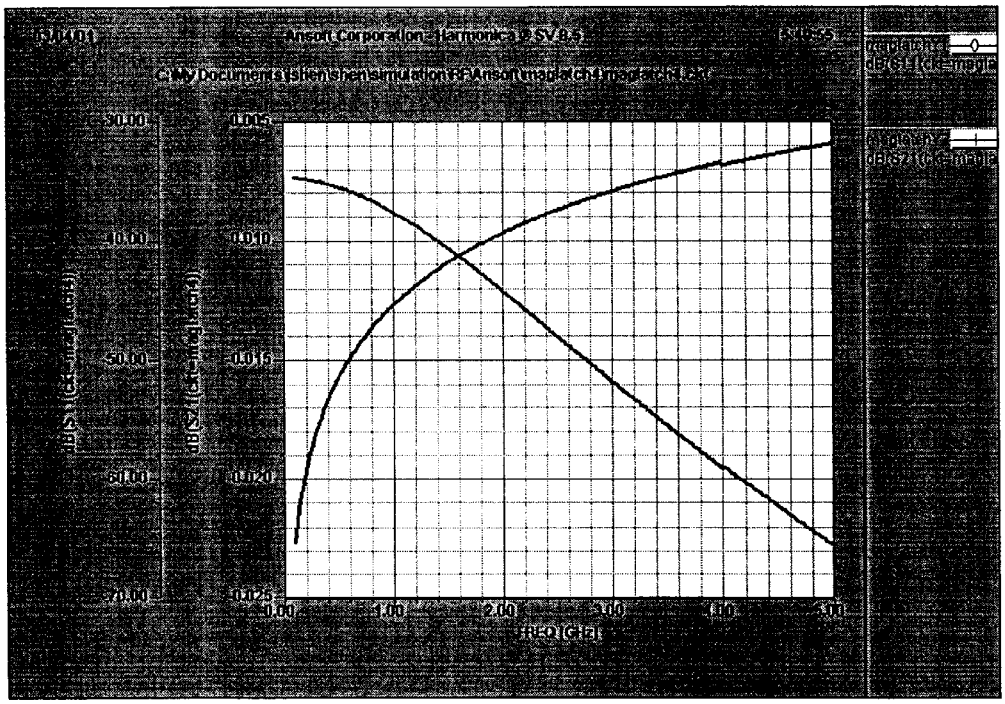

FIG. 9B illustrates results of a simulation for the micro-machined RF switch schematic equivalent circuit diagram shown in FIG. 9A.

Figure 10A:
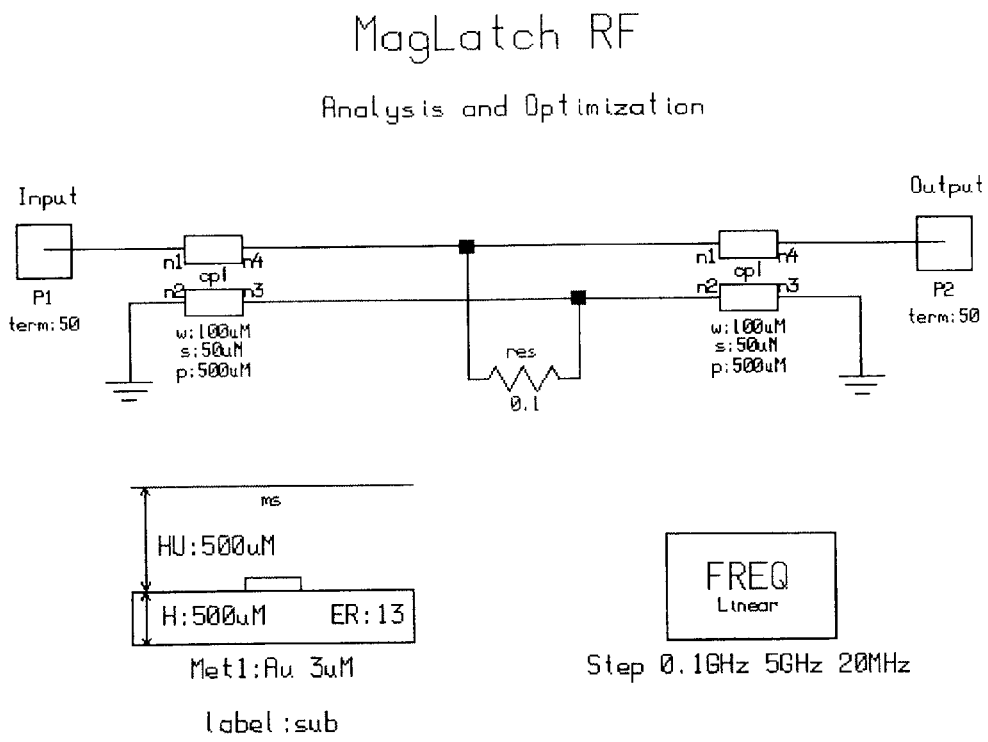

FIG. 10A illustrates an example micro-machined RF switch schematic equivalent circuit diagram, which is in the "OFF" state, according to the present invention.

Figure 10B:
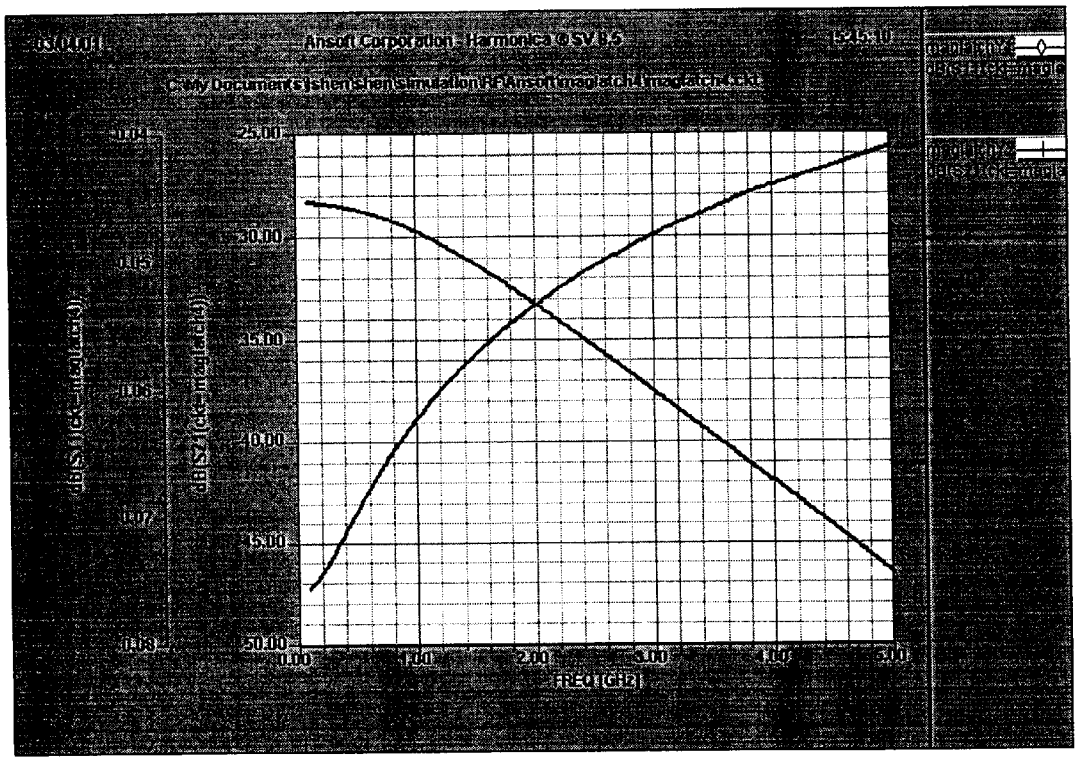

FIG. 10B illustrates results of a simulation for the micro-machined RF switch schematic equivalent circuit diagram shown in FIG. 10A.

FIGS. 11A–11G illustrate flowcharts related to the micro-machined RF switch shown in FIGS. 7A–7C.

FIGS. 12A–12F illustrate flowcharts related to the micro-machined RF switch shown in FIGS. 8A–8C.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal suicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in international patent publications WO0157899 (titled Electronically Switching Latching Micro-magnetic Relay And Method of Operating Same), and WO0184211 (titled Electronically Micro-magnetic latching switches and Method of Operating Same), to Shen et al. These patent publications provide a thorough background on micro-magnetic latching switches and are incorporated herein by reference in their entirety. Moreover, the details of the switches disclosed in WO0157899 and WO0184211 are applicable to implement the switch embodiments of the present invention as described below.

Overview of a Latching Switch

Figure 1A:
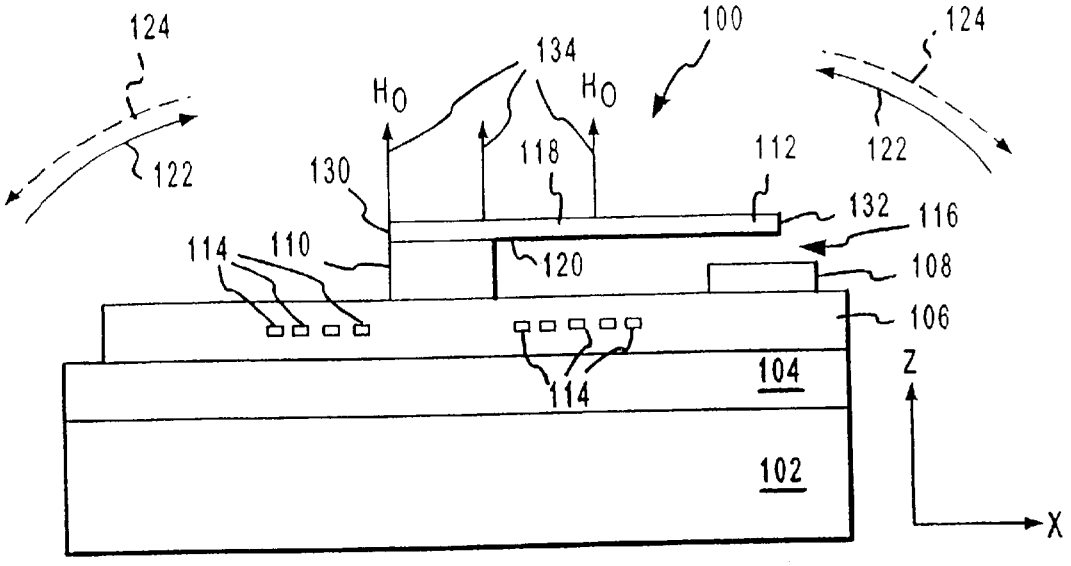
FIGS. 1A and 1B are side and top views, respectively, of an exemplary embodiment of a switch.
Figure 1B:
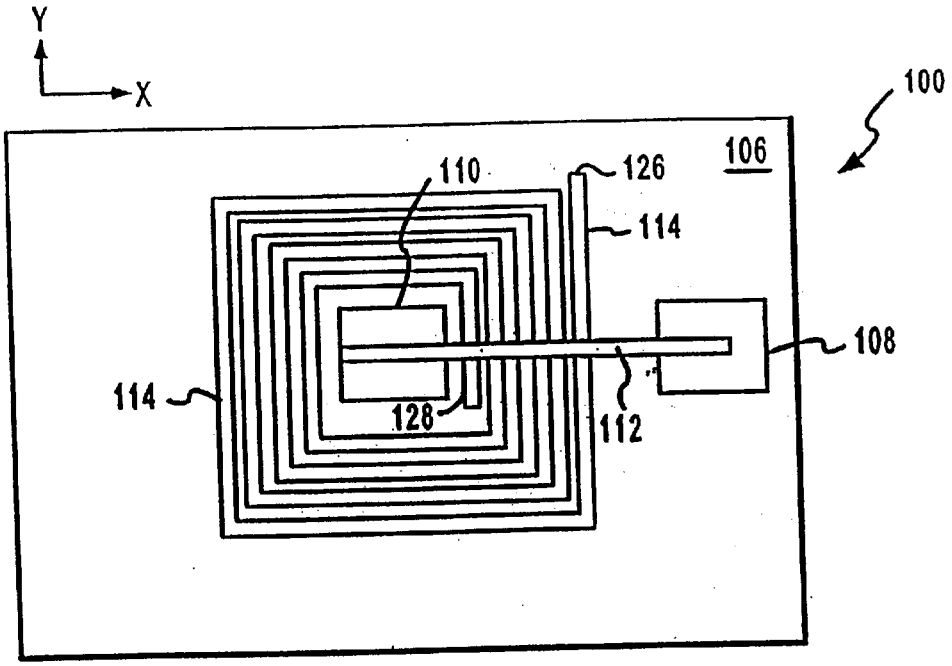

FIGS. 1A and 1B show side and top views, respectively, of a latching switch. The terms switch and device are used herein interchangeably to described the structure of the present invention. With reference to FIGS. 1A and 1B, an exemplary latching relay 100 suitably includes a magnet 102, a substrate 104, an insulating layer 106 housing a conductor 114, a contact 108 and a cantilever (moveable element) 112 positioned or supported above substrate by a staging layer 110.

Magnet 102 is any type of magnet such as a permanent magnet, an electromagnet, or any other type of magnet capable of generating a magnetic field $H_0$ 134, as described more fully below. By way of example and not limitation, the magnet 102 can be a model 59-P09213T001 magnet available from the Dexter Magnetic Technologies corporation of Fremont, Calif., although of course other types of magnets could be used. Magnetic field 134 can be generated in any manner and with any magnitude, such as from about 1 Oersted to $10^4$ Oersted or more. The strength of the field depends on the force required to hold the cantilever in a given state, and thus is implementation dependent. In the exemplary embodiment shown in FIG. 1A, magnetic field $H_0$ 134 can be generated approximately parallel to the Z axis and with a magnitude on the order of about 370 Oersted, although other embodiments will use varying orientations and magnitudes for magnetic field 134. In various embodiments, a single magnet 102 can be used in conjunction with a number of relays 100 sharing a common substrate 104.

Substrate 104 is formed of any type of substrate material such as silicon, gallium arsenide, glass, plastic, metal or any other substrate material. In various embodiments, substrate 104 can be coated with an insulating material (such as an oxide) and planarized or otherwise made flat. In various embodiments, a number of latching relays 100 can share a single substrate 104. Alternatively, other devices (such as transistors, diodes, or other electronic devices) could be formed upon substrate 104 along with one or more relays 100 using, for example, conventional integrated circuit manufacturing techniques. Alternatively, magnet 102 could be used as a substrate and the additional components discussed below could be formed directly on magnet 102. In such embodiments, a separate substrate 104 may not be required.

Insulating layer 106 is formed of any material such as oxide or another insulator such as a thin-film insulator. In an exemplary embodiment, insulating layer is formed of Probimide 7510 material. Insulating layer 106 suitably houses conductor 114. Conductor 114 is shown in FIGS. 1A and 1B to be a single conductor having two ends 126 and 128 arranged in a coil pattern. Alternate embodiments of conductor 114 use single or multiple conducting segments arranged in any suitable pattern such as a meander pattern, a serpentine pattern, a random pattern, or any other pattern. Conductor 114 is formed of any material capable of conducting electricity such as gold, silver, copper, aluminum, metal or the like. As conductor 114 conducts electricity, a magnetic field is generated around conductor 114 as discussed more fully below.

Cantilever (moveable element) 112 is any armature, extension, outcropping or member that is capable of being affected by magnetic force. In the embodiment shown in FIG. 1A, cantilever 112 suitably includes a magnetic layer 118 and a conducting layer 120. Magnetic layer 118 can be formulated of permalloy (such as NiFe alloy) or any other magnetically sensitive material. Conducting layer 120 can be formulated of gold, silver, copper, aluminum, metal or any other conducting material. In various embodiments, cantilever 112 exhibits two states corresponding to whether relay 100 is "open" or "closed", as described more fully below. In many embodiments, relay 100 is said to be "closed" when a conducting layer 120, connects staging layer 110 to contact 108. Conversely, the relay may be said to be "open" when cantilever 112 is not in electrical contact with contact 108. Because cantilever 112 can physically move in and out of contact with contact 108, various embodiments of cantilever 112 will be made flexible so that cantilever 112 can bend as appropriate. Flexibility can be created by varying the thickness of the cantilever (or its various component layers), by patterning or otherwise making holes or cuts in the cantilever, or by using increasingly flexible materials.

Alternatively, cantilever 112 can be made into a "hinged" arrangement. Although of course the dimensions of cantilever 112 can vary dramatically from implementation to implementation, an exemplary cantilever 112 suitable for use in a micro-magnetic relay 100 can be on the order of 10–1000 microns in length, 1–40 microns in thickness, and 2–600 microns in width. For example, an exemplary cantilever in accordance with the embodiment shown in FIGS. 1A and 1B can have dimensions of about 600 microns×10 microns×50 microns, or 1000 microns×600 microns×25 microns, or any other suitable dimensions.

Contact 108 and staging layer 110 are placed on insulating layer 106, as appropriate. In various embodiments, staging layer 110 supports cantilever 112 above insulating layer 106, creating a gap 116 that can be vacuum or can become filled with air or another gas or liquid such as oil. Although the size of gap 116 varies widely with different implementations, an exemplary gap 116 can be on the order of 1–100 microns, such as about 20 microns, Contact 108 can receive cantilever 112 when relay 100 is in a closed state, as described below. Contact 108 and staging layer 110 can be formed of any conducting material such as gold, gold alloy, silver, copper, aluminum, metal or the like. In various embodiments, contact 108 and staging layer 110 are formed of similar conducting materials, and the relay is considered to be "closed" when cantilever 112 completes a circuit between staging layer 110 and contact 108. In certain embodiments wherein cantilever 112 does not conduct electricity, staging layer 110 can be formulated of non-conducting material such as Probimide material, oxide, or any other material. Additionally, alternate embodiments may not require staging layer 110 if cantilever 112 is otherwise supported above insulating layer 106.

Principle of Operation of a Micro-Magnetic Latching Switch

When it is in the "down" position, the cantilever makes electrical contact with the bottom conductor, and the switch is "ON" (also called the "closed" state). When the contact end is "up", the switch is "OFF" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-Stability

Figure 2:
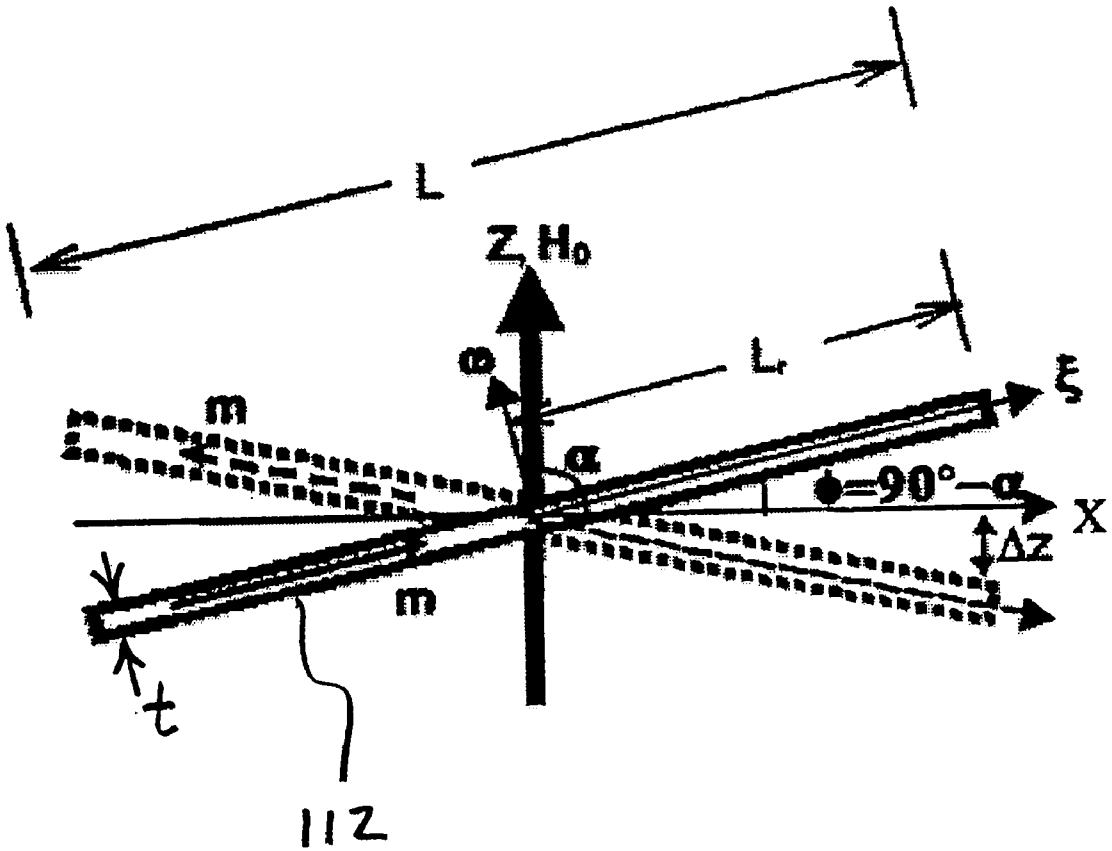
FIG. 2 illustrates the principle by which bi-stability is produced.

The principle by which bi-stability is produced is illustrated with reference to FIG. 2. When the length L of a permalloy cantilever 112 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field ($H_0$) is smaller than 90°, the torque is counterclockwise; and when $\alpha$ is larger than 90°, the torque is clockwise. The bi-directional torque arises because of the bi-directional magnetization (i.e., a magnetization vector "m" points one direction or the other direction, as shown in FIG. 2) of the cantilever (m points from left to right when $\alpha<90°$, and from right to left when $\alpha>90°$). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the $\xi$-component (along the cantilever, see FIG. 2) of this field that is used to reorient the magnetization (magnetization vector "m") in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component [$H_0\xi \sim H_0 \cos(\alpha)=H_0 \sin(\phi)$, $\alpha=90°-\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B_2 \cdot n = B_1 \cdot n,$$

$$B_2 \times n = (\mu_2/\mu_1) B_1 \times n$$

or $$H_2 \cdot n = (\mu_2/\mu_1) H_1 \cdot n,$$

$$H_2 \times n = H_1 \times n$$

Figure 3:
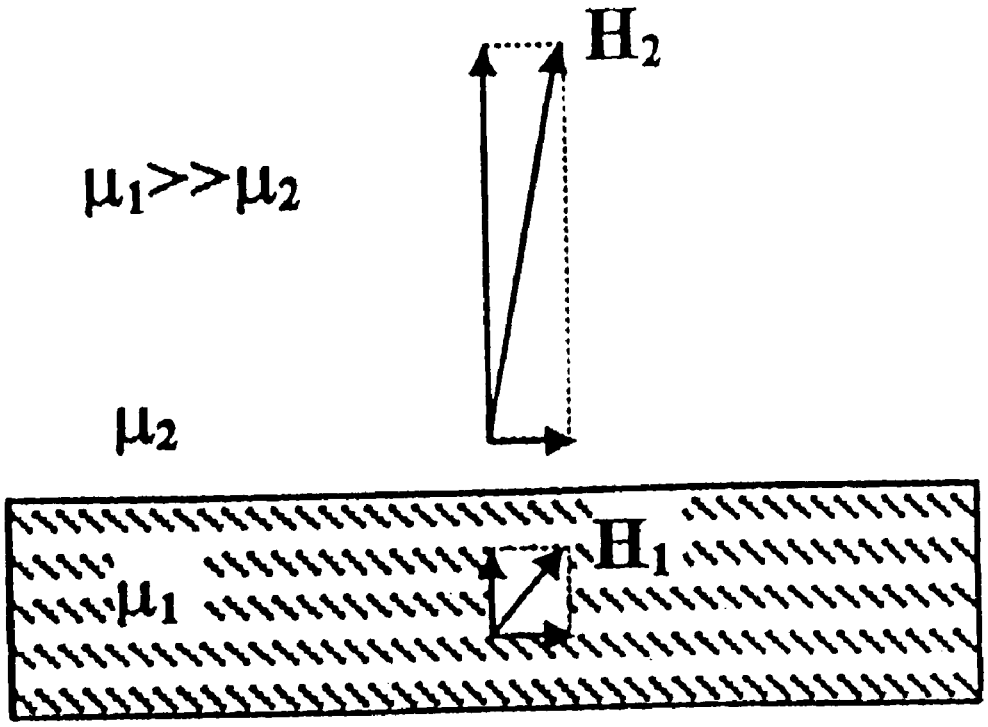
FIG. 3 illustrates the boundary conditions on the magnetic field (H) at a boundary between two materials with different permeability ($\mu 1 >> \mu 2$).

If $\mu_1 >> \mu_2$, the normal component of $H_2$ is much larger than the normal component of $H_1$, as shown in FIG. 3. In the limit $(\mu_1/\mu_2) \rightarrow \infty$, the magnetic field $H_2$ is normal to the boundary surface, independent of the direction of $H_1$ (barring the exceptional case of $H_1$ exactly parallel to the interface). If the second media is air ($\mu_2$=1), then $B_2 = \mu_0 H_2$, so that the flux lines $B_2$ will also be perpendicular to the surface. This property is used to produce magnetic fields that are perpendicular to the horizontal plane of the cantilever in a micro-magnetic latching switch and to relax the permanent magnet alignment requirements.

FIGS. 4A and 4B show computer simulations of magnetic flux (B) distributions. As shown in FIG. 4A, without a second magnetic layer, such as a high-permeability magnetic layer, the flux lines are less perpendicular to the horizontal plane, resulting in a large horizontal (x) component. As shown in FIG. 4*b*, when a second magnetic layer, such as a high-permeability magnetic layer, is introduced with its surface parallel to the horizontal plane, the magnetic flux lines are approximately perpendicular to the horizontal plane in a relatively large region. The region indicated by a box with dashed lines in FIG. 4B is the preferred location of the switch, with the cantilever horizontal plane parallel to the horizontal axis (x). The features and advantages of this "dipole" arrangement for micro-magnetic latching switches are fully described in U.S. non-provisional patent application Ser. No. 10/051,447, filed Jan. 8, 2002, which is incorporated herein by reference.

FIGS. 5A–C show the extracted horizontal components (Bx) of the magnetic flux along cut-lines at various heights (y=−75 mm, −25 mm, 25 mm . . . ). FIGS. 5A–5C correspond to case (a) single permanent magnet, (b) a permanent magnet with a high-permeability magnetic layer (thickness t=100 mm), and another case where the high-permeability magnetic layer thickness is t=25 mm. In FIG. 5A, without the high-permeability magnetic layer, Bx increases rapidly away from the center. In FIG. 5B, Bx is reduced from that shown in FIG. 5A, due to the use of the high-permeability magnetic layer. FIG. 5C shows that a thinner high-m layer is less effective than the thicker one shown in FIG. 5B.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

Micro-Machined RF Switches of the Present Invention

The micro-machined RF switch of the present invention includes micro-machined cantilevers, transmission lines suitable for RF signal propagation, and various actuation mechanisms to engage the cantilever to contact the RF signal transmission lines. The cantilever is controlled to coupled and decouple the RF signal transmission lines to and from a reference signal to effectively turn the RF switch "off" and "on."

FIGS. 6A–6C show high level views of a micro-machined RF switch 600, according to embodiments of the present invention. FIG. 6A shows a top view, and FIGS. 6B and 6C show cross-sectional views of micro-machined RF switch 600. As shown in FIGS. 6A–6C, micro-machined RF switch 600 includes substrate 104, a co-planar wave guide structure 612, and cantilever 112. As shown in FIG. 6B, a bottom surface of cantilever assembly 112 has a conducting layer 120 formed thereon.

As shown in FIG. 6A, in an embodiment, co-planar wave guide structure 612 is formed on substrate 104, and includes an RF signal transmission line 606 positioned between a first reference signal 608 and a second reference signal 610. In a preferred embodiment, first reference signal 608 and second reference signal 610 are ground lines, but may be coupled to other reference potential values. RF signal transmission line 606, first reference signal 608, and second reference signal 610 are preferably metal traces, or other structures that conduct RF signals, as described above. An RF signal is input to RF switch 600 at RF input 602. The RF signal is conducted from RF input 602, through co-planar wave guide structure 612, to RF output 604, which is an RF signal output for RF switch 600.

In the embodiment shown in FIGS. 6A–6C, cantilever 112 has two states. FIG. 6B shows a first state for cantilever 112, and FIG. 6C shows a second state for cantilever 112. In FIG. 6B, a right end of cantilever 112 is rotated downward. Furthermore, conducting layer 120 on the bottom surface of cantilever 112 electrically couples (i.e., shorts) RF signal transmission line 606 and reference signal 608. Therefore, an RF signal cannot effectively propagate through RF signal transmission line 606. Partial or total reflection of the RF signal from RF input 602 is caused, and the first state for RF switch 600 is considered to be an "OFF" state. In embodiments, cantilever 112 can be used to couple RF signal transmission line 606 to either one or both of first and second reference signals 608 and 610.

Note that in FIG. 6B, a cantilever portion 614 of cantilever 112 is bent or angled with respect the rest of cantilever 112. Cantilever portion 614 may be preformed to have an angle with respect to the rest of cantilever 112 (although not shown in FIG. 6C). Alternatively, all of cantilever 112, or just cantilever portion 614, may flex or be flexible. Angling and/or flexing of cantilever portion 614 can be used to enhance the coupling of first reference signal 608 to RF signal transmission line 606. In this manner, cantilever portion 614 is allowed to be more parallel to, or to conform more closely to substrate 104 than the rest of cantilever 112, which is situated at an angle to substrate 104.

In FIG. 6C, cantilever portion 614 of cantilever 112 is rotated upward. Furthermore, conducting layer 120 on the bottom surface of cantilever 112 is not in contact with RF signal transmission line 606 and/or with either of reference signals 608 and 610. Therefore, an RF signal can propagate through RF signal transmission line 606 with relatively little loss and reflection in RF switch 600. Hence, the second state for RF switch 600 is considered to be an "ON" state.

The present invention is adaptable to numerous embodiments for RF switch 600. For example, an RF signal can be conducted through RF switch 600 by a transmission medium other than co-planar wave guide structure 612 shown in FIGS. 6A–6C. For instance, in an alternative embodiment, RF switch 600 can include microstrip signal lines with ground planes below and/or above the microstrip signal lines. Furthermore, various actuation mechanisms (electrostatic, electromagnetic, thermal, piezoelectric, etc.) can be used to switch cantilever 112 between the first and second states. Still further, in embodiments, RF switch 600 can accommodate more than two states. Embodiments for RF switch 600 using electromagnetic actuation mechanisms and electrostatic actuation mechanisms are described in further detail in the following subsections.

FIGS. 7A–7C illustrate detailed views of micro-machined RF switch 600 with an electromagnetic actuation mechanism, according to an embodiment of the present invention. FIG. 7A shows a top view, and FIGS. 7B and 7C show cross-sectional views of micro-machined RF switch 600. As shown in FIGS. 7A–7C, RF switch 600 includes substrate 104, cantilever 112, co-planar wave guide structure 612, a torsion spring 704, conductor or coil 114, a conductor line 710, a bottom permanent magnet 712, a top permanent magnet 714, and a dielectric layer 716.

As shown in FIGS. 7B and 7C, cantilever assembly 112 includes bottom conducting layer 120, a first soft magnetic layer 706, and a second soft magnetic layer 702. The invention is also applicable to fewer or additional soft magnetic layers. Second soft magnetic layer 702 is shown in FIG. 7A as having three sections for illustrative purposes, and in alternative embodiments may have any number of one or more sections. First and/or second soft magnetic layers 706 and 702 are manufactured from soft magnetic materials, as are described above.

Conductor line 710 couples conducting layer 120 to reference signal 608 through torsion spring 704. In a preferred embodiment, as described above, reference signal 608 is a ground line. Hence, in the preferred embodiment, conductor line 710 couples conducting layer 120 to the ground line of reference signal 608 through torsion spring 704.

As shown in FIG. 7A, cantilever 112 is supported by torsion spring 704 from two sides. Torsion spring 704 flexes to allow cantilever 112 to rotate according to the magnetic actuation mechanism described herein.

Bottom and top permanent magnets 712 and 714 provide a substantially uniform and constant magnetic field in a region 718 between them, as described above with regard to magnet 102 shown in FIG. 1, and as further described above in the discussion regarding relaxed alignment of magnets. Cantilever 112 is located in the magnetic field between bottom and top permanent magnets 712 and 714. The magnetic flux lines due to bottom and top permanent magnets 712 and 714 are substantially perpendicular to the longitudinal axis (as shown in FIG. 2) of cantilever 112. Spacers and packages appropriate to the particular application are used to support bottom and top permanent magnets 712 and 714.

Dielectric layer 716 houses coil 114, and is substantially similar to insulating layer 106 described above with regard to FIGS. 1A and 1B. Conductor or coil 114 is also further described above with regard to FIGS. 1A and 1B.

During operation, cantilever 112 resides in one of two stable states. FIG. 7B shows a first stable state for cantilever 112, and FIG. 7C shows a second stable state for cantilever 112. A current pulse through coil 114 produces a temporary magnetic field which can realign the magnetization in soft magnetic layers 706 and 702 of cantilever 112, and switches cantilever 112 between the two stable states, as described above. After the current pulse through coil 114 ends, cantilever 112 remains in the particular one of first and second stable states that it has moved or rotated into. Hence, the states are stable.

In FIG. 7B, a right end of cantilever 112 having a cantilever portion 722 is rotated downward. Hence, a torque was exerted on cantilever 112 by the temporary magnetic field causing cantilever 112 to rotate in this direction in an attempt to align with the temporary magnetic field, as described above. Conducting layer 120 on the bottom surface of cantilever 112 electrically couples (i.e., shorts) RF signal transmission line 606 and reference signal 608. Therefore, an RF signal cannot effectively propagate through RF signal transmission line 606. Partial or total reflection of the RF signal from RF input 602 is caused, and the first stable state for RF switch 600 is considered to be an "OFF" state.

Note that cantilever portion 722 of cantilever 112 can be angled and/or flexible. In this manner an enhanced electrical contact can be formed between RF signal transmission line 606 and reference signal 608 in the "OFF" state shown in FIG. 7B. This is further described above with regard to cantilever portion 614 shown in FIGS. 6A and 6B.

In FIG. 7C, the right end of cantilever 112 is rotated upward. Hence, a torque was exerted on cantilever 102 by the temporary magnetic field causing cantilever 112 to rotate in this direction in an attempt to align with the temporary magnetic field, as described above. Conducting layer 120 on the bottom surface of cantilever 112 is not in contact with RF signal transmission line 606 and/or with either of reference signals 608 and 610. Therefore, an RF signal can propagate through RF signal transmission line 606 with relatively little loss and reflection in RF switch 600. Hence, the second stable state for RF switch 600 is considered to be an "ON" state.

In the embodiment shown in FIGS. 7A–7C, RF switch 600 is shown as a latching single-pole single-throw switch. Note that in alternative embodiments, single-pole double-throw and other configurations for a magnetically actuated RF switch 600 are also possible, as would be understood by persons skilled in the relevant art(s) from the teachings herein.

Figure 11A:
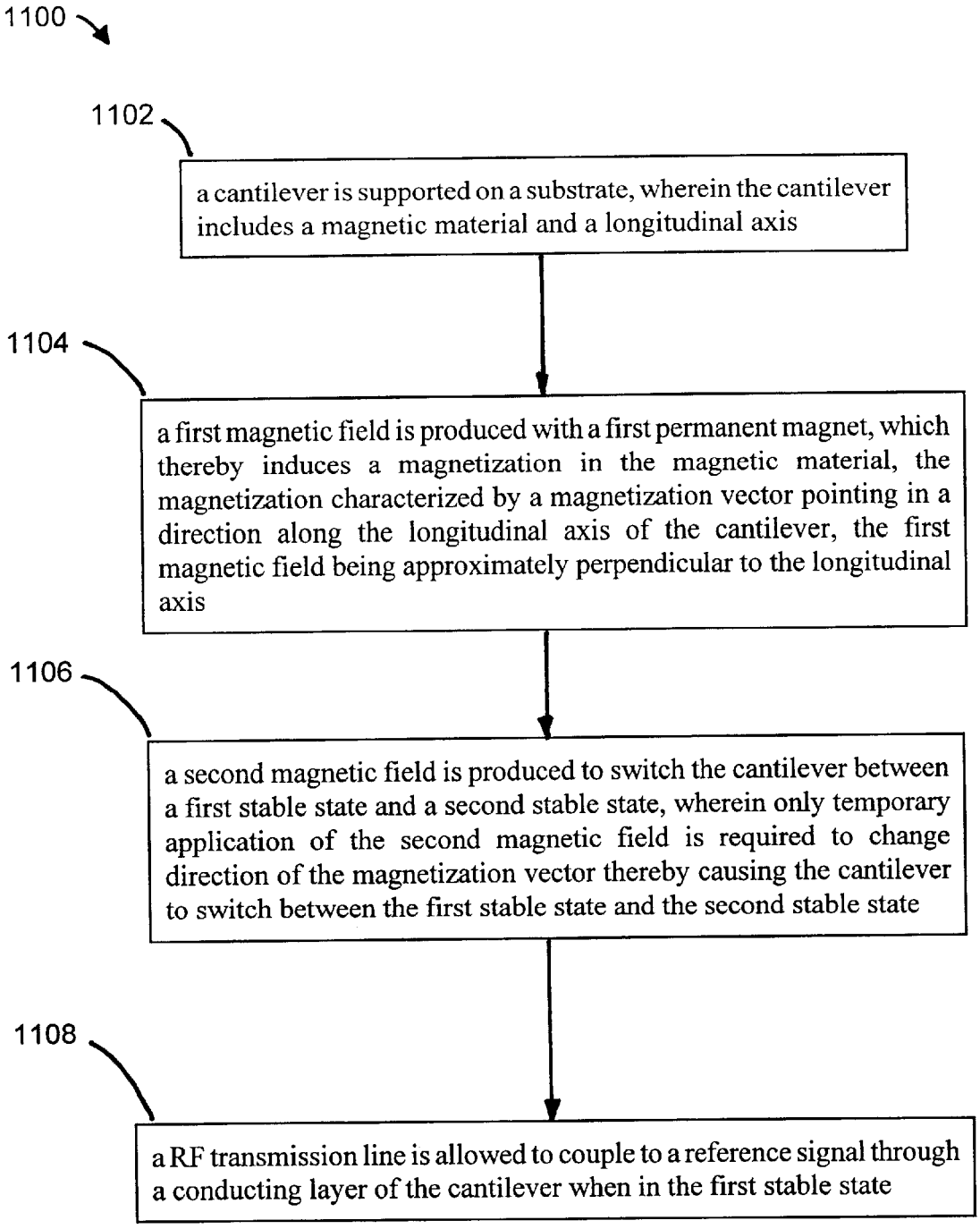

FIG. 11A shows a flowchart 1100 providing steps for operating magnetically actuated micro-machined RF switch embodiments of the present invention. FIGS. 11B–11G show additional steps, according to further embodiments of the present invention. The steps of FIGS. 11A–11G do not necessarily have to occur in the order shown, as will be apparent to persons skilled in the relevant art(s) based on the teachings herein. Other structural embodiments will be apparent to persons skilled in the relevant art(s) based on the following discussion. These steps are described in detail below.

Flowchart 1100 begins in FIG. 11A with step 1102. In step 1102, a cantilever is supported on a substrate, wherein the cantilever includes a magnetic material and a longitudinal axis. For example, the cantilever is cantilever 112 of RF switch 600, shown in FIGS. 7A–7C. Cantilever 112 is shown supported on substrate 104. The magnetic material can be one or both of soft magnetic layers 702 and 706, for example. The longitudinal axis is an axis of cantilever 112 in line with the long axis L shown for cantilever 112 in FIG. 2.

In step 1104, a first magnetic field is produced with a first permanent magnet, which thereby induces a magnetization in the magnetic material, the magnetization characterized by a magnetization vector pointing in a direction along the longitudinal axis of the cantilever, the first magnetic field being approximately perpendicular to the longitudinal axis. For example, the first magnetic field is $H_0$ 134, as shown in FIGS. 1A and 1B. The magnetic field can be produced by bottom permanent magnet 712. In an alternative embodiment, the magnetic field is produced by more than one permanent magnets, such as both of bottom and top permanent magnets 712 and 714. A magnetization induced in the magnetic material can be characterized as a magnetization vector, such as magnetization vector "m" as shown in FIG. 2. As shown in FIG. 1, first magnetic field $H_0$ 134 is approximately perpendicular to long axis L shown for cantilever 112 in FIG. 2.

In step 1106, a second magnetic field is produced to switch the cantilever between a first stable state and a second stable state, wherein only temporary application of the second magnetic field is required to change direction of the magnetization vector thereby causing the cantilever to switch between the first stable state and the second stable state. For example, the second magnetic field is produced by an electromagnet, such as coil 114 shown in FIGS. 7A–7C. The second magnetic field switches cantilever 112 between two stable states, such as shown in FIGS. 7B and 7C. As described above, only a temporary application of the second magnetic field produced by coil 114 is required to change direction of magnetization vector "m" shown in FIG. 2. Changing the direction of magnetization vector "m" causes cantilever 112 to switch between the first stable state, an "OFF" state for RF switch 600 shown in FIG. 7B, and the second stable state, an "ON" state for RF switch 600 shown in FIG. 7C.

In step 1108, a RF transmission line is allowed to couple to a reference signal through a conducting layer of the cantilever when in the first stable state. For example, the RF transmission line is RF transmission line 606 shown in FIGS. 7A–7C. As shown in FIG. 7B, RF transmission line 606 is allowed to couple to reference signal 608 through conducting layer 120 of cantilever 112 when in the first stable state. The portion of conducting layer 120 on the bottom of cantilever portion 722 couples reference signal 608 to RF transmission line 606.

Figure 11B:
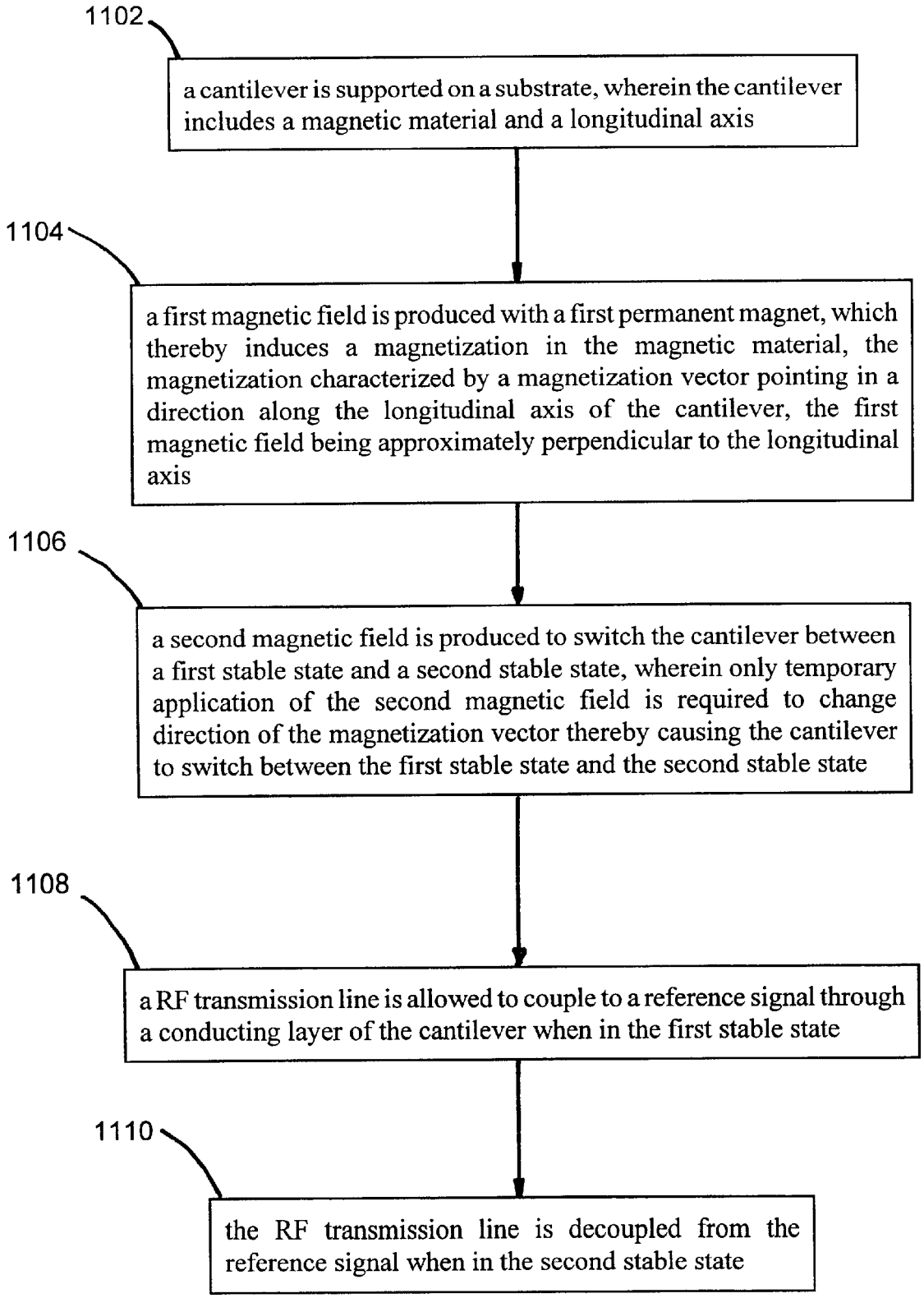

FIG. 11B shows flowchart 1100 with an additional step 1110. In step 1110, the RF transmission line is decoupled from the reference signal when in the second stable state. For example, as shown in FIG. 7C, RF transmission line 606 is decoupled from reference signal 608 when in the second stable state.

In an embodiment, step 1106 can include the step where the second magnetic field is produced with an electromagnet. For example, as shown in FIGS. 7A–7C, the electromagnet can be conductor or coil 114, or further type of electromagnet.

In an embodiment, step 1102 can include the step where the first magnetic field is produced with the first permanent magnet and a second permanent magnet, wherein the cantilever is located between the first permanent magnet and the second permanent magnet. For example, the second permanent magnet is top permanent magnet 714 shown in FIG. 7B, wherein cantilever 112 is located in region 718 between them.

Figure 11C:
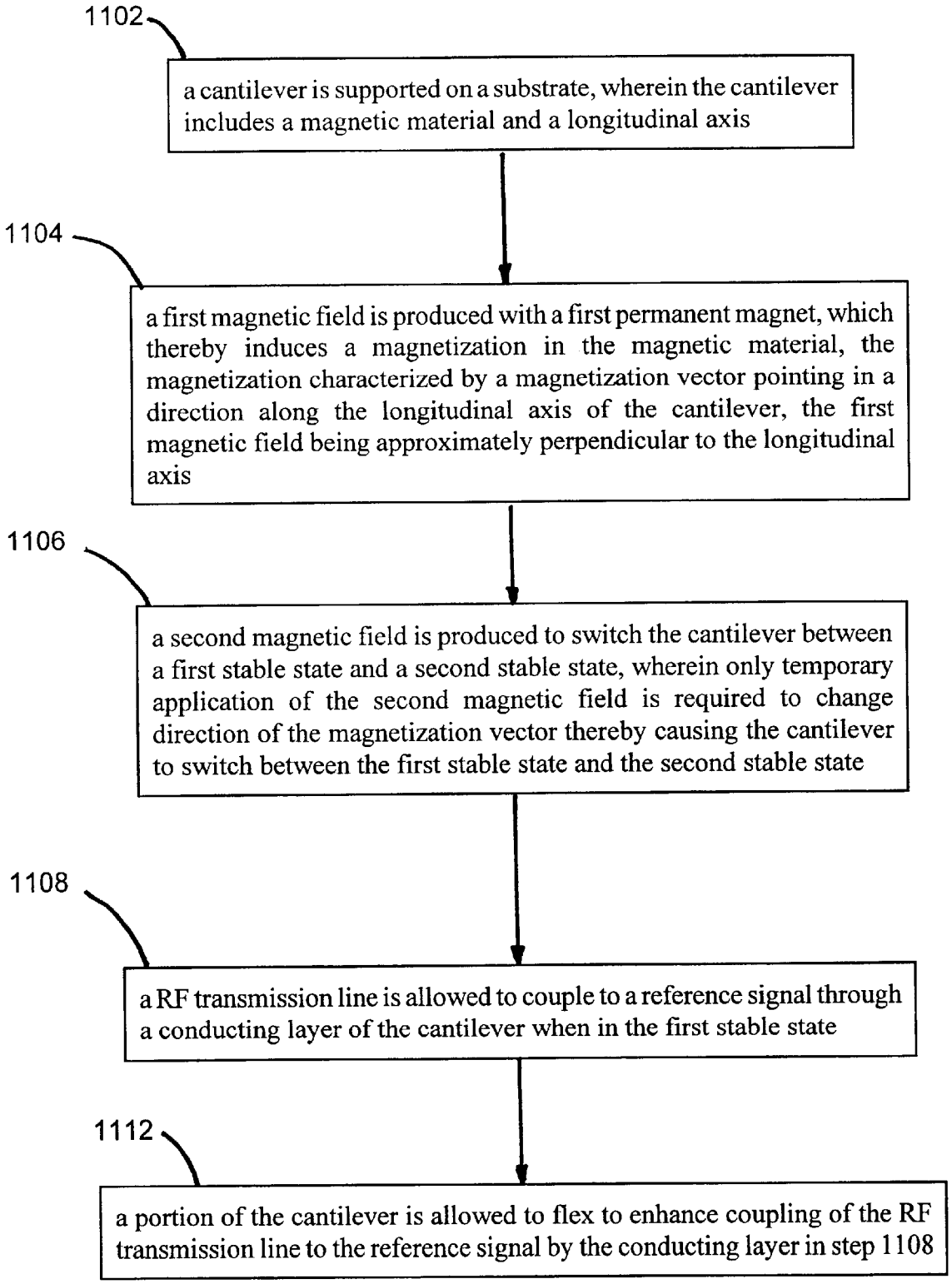

FIG. 11C shows flowchart 1100 with an additional step 1112. In step 1112, a portion of the cantilever is allowed to flex to enhance coupling of the RF transmission line to the reference signal by the conducting layer in step 1108. For example, the portion of the cantilever that is allowed to flex is cantilever portion 722, shown in FIG. 7B. Cantilever portion 722 flexes to allow conducting layer 120 to more closely couple RF transmission line 606 to reference signal 608.

Figure 11D:
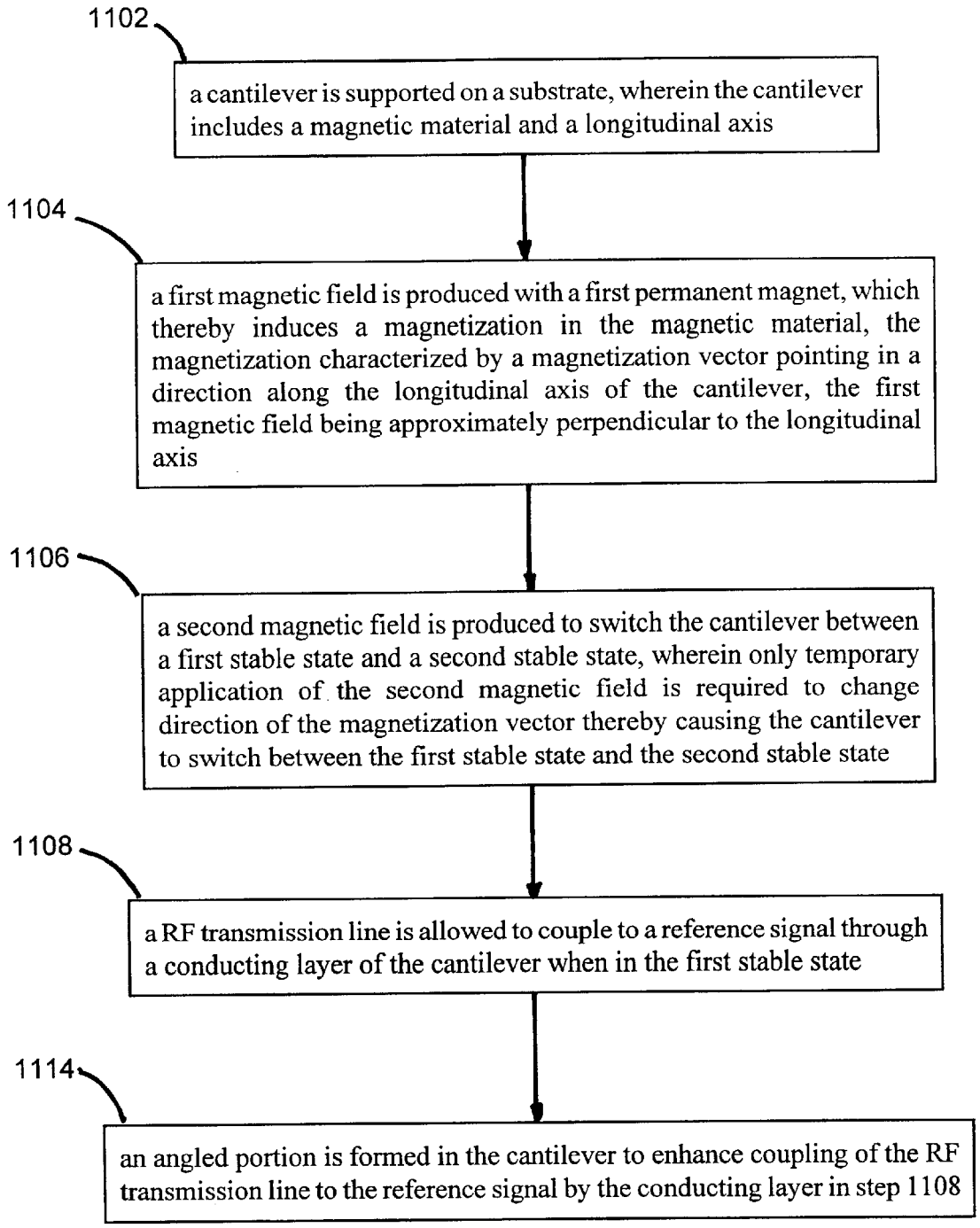

FIG. 11D shows flowchart 1100 with an additional step 1114. In step 1114, an angled portion is formed in the cantilever to enhance coupling of the RF transmission line to the reference signal by the conducting layer in step 1108. For example, in an alternative embodiment, cantilever portion 722 is an angled portion of cantilever 112. Cantilever portion 722 can be pre-formed at an angle to the remainder of cantilever 112, such as the angle shown in FIG. 7B. This angle of cantilever portion 722 allows conducting layer 120 to more closely couple RF transmission line 606 to reference signal 608.

Figure 11E:
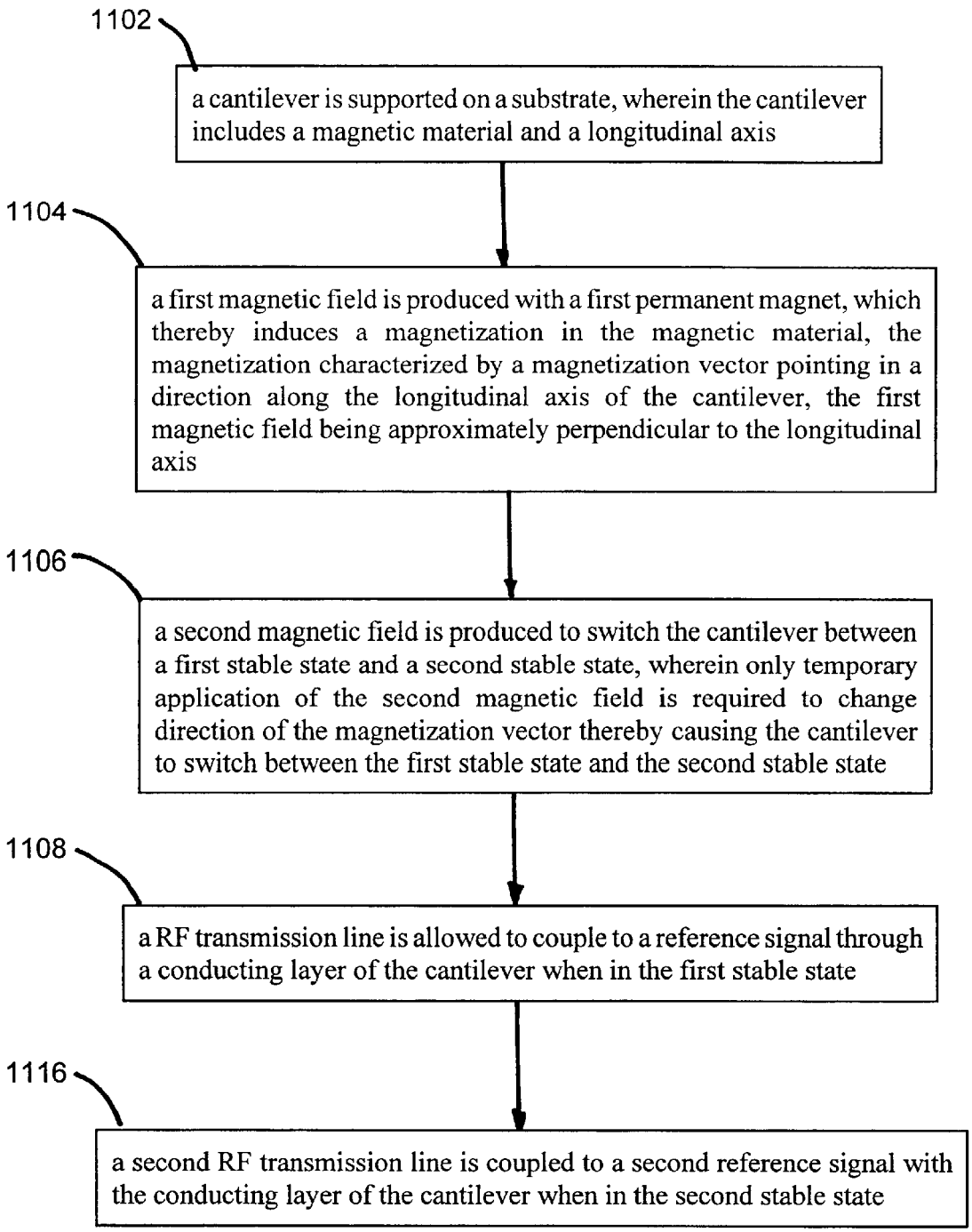

FIG. 11E shows flowchart 1100 with an additional step 1116. In step 1116, a second RF transmission line is coupled to a second reference signal with the conducting layer of the cantilever when in the second stable state. For example, RF switch 600 may also provide an "OFF" condition for a second RF transmission line when in the second stable state shown in FIG. 7C. A second RF transmission line (not shown in FIG. 7C) can be coupled to a second reference signal by conducting layer 120 under left end cantilever portion 720 of cantilever 112 when in the second stable state, in a similar fashion to that shown for first RF transmission line 606 and reference signal 608 in FIG. 7B.

Figure 11F:
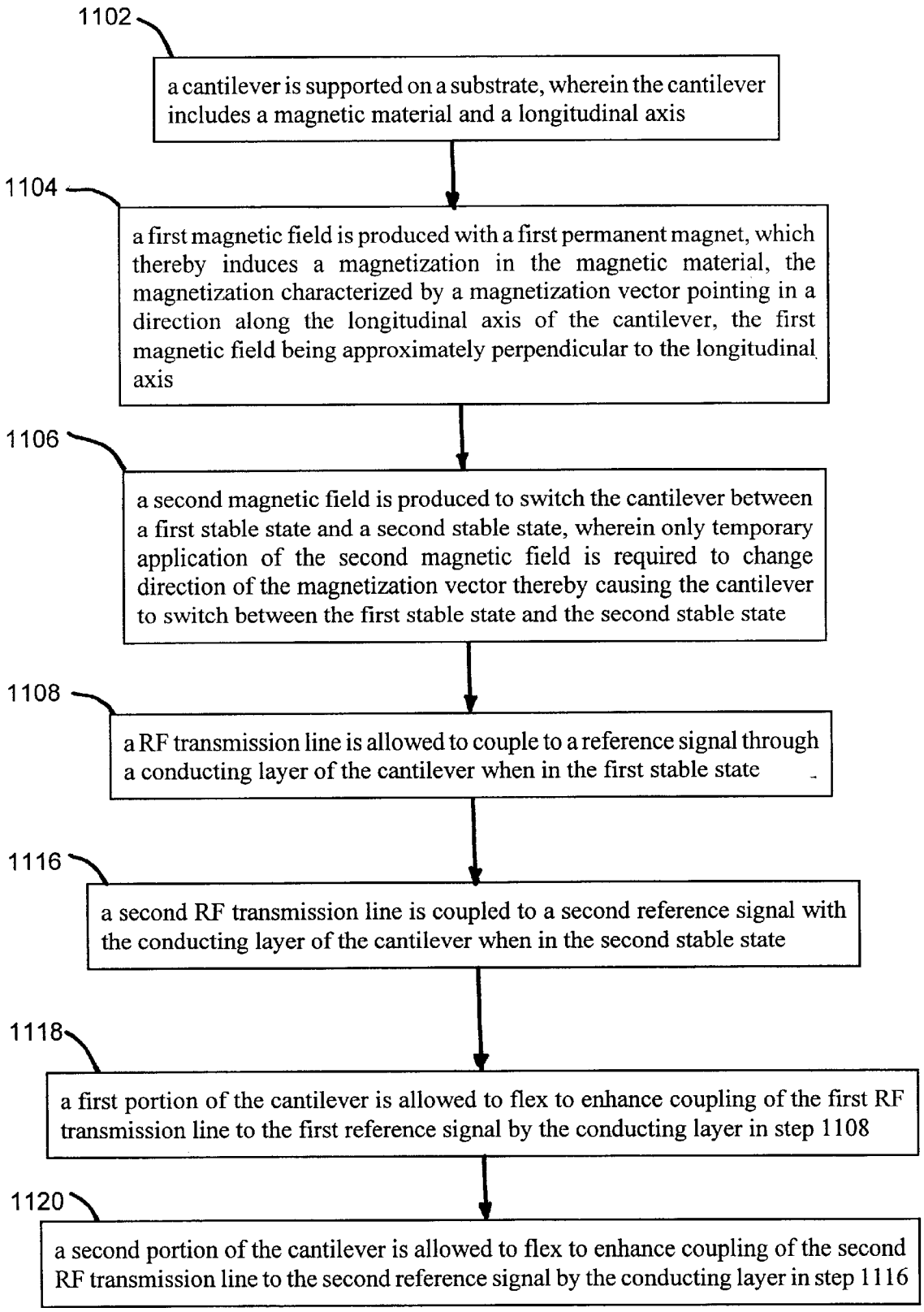

FIG. 11F shows the flowchart of FIG. 11E with additional steps. In step 1118, a first portion of the cantilever is allowed to flex to enhance coupling of the first RF transmission line to the first reference signal by the conducting layer in step 1108. For example, the first portion of the cantilever that is allowed to flex is cantilever portion 722, shown in FIG. 7B. Cantilever portion 722 flexes to allow conducting layer 120 to more closely couple RF transmission line 606 to reference signal 608.

In step 1120, a second portion of the cantilever is allowed to flex to enhance coupling of the second RF transmission line to the second reference signal by the conducting layer in step 1116. For example, the portion of the cantilever that is allowed to flex is cantilever portion 720, shown in FIG. 7B. Cantilever portion 720 flexes to allow conducting layer 120 to more closely couple the second RF transmission line (not shown in FIGS. 7A–7C) to the second reference signal (also not shown in FIGS. 7A–7C).

Figure 11G:
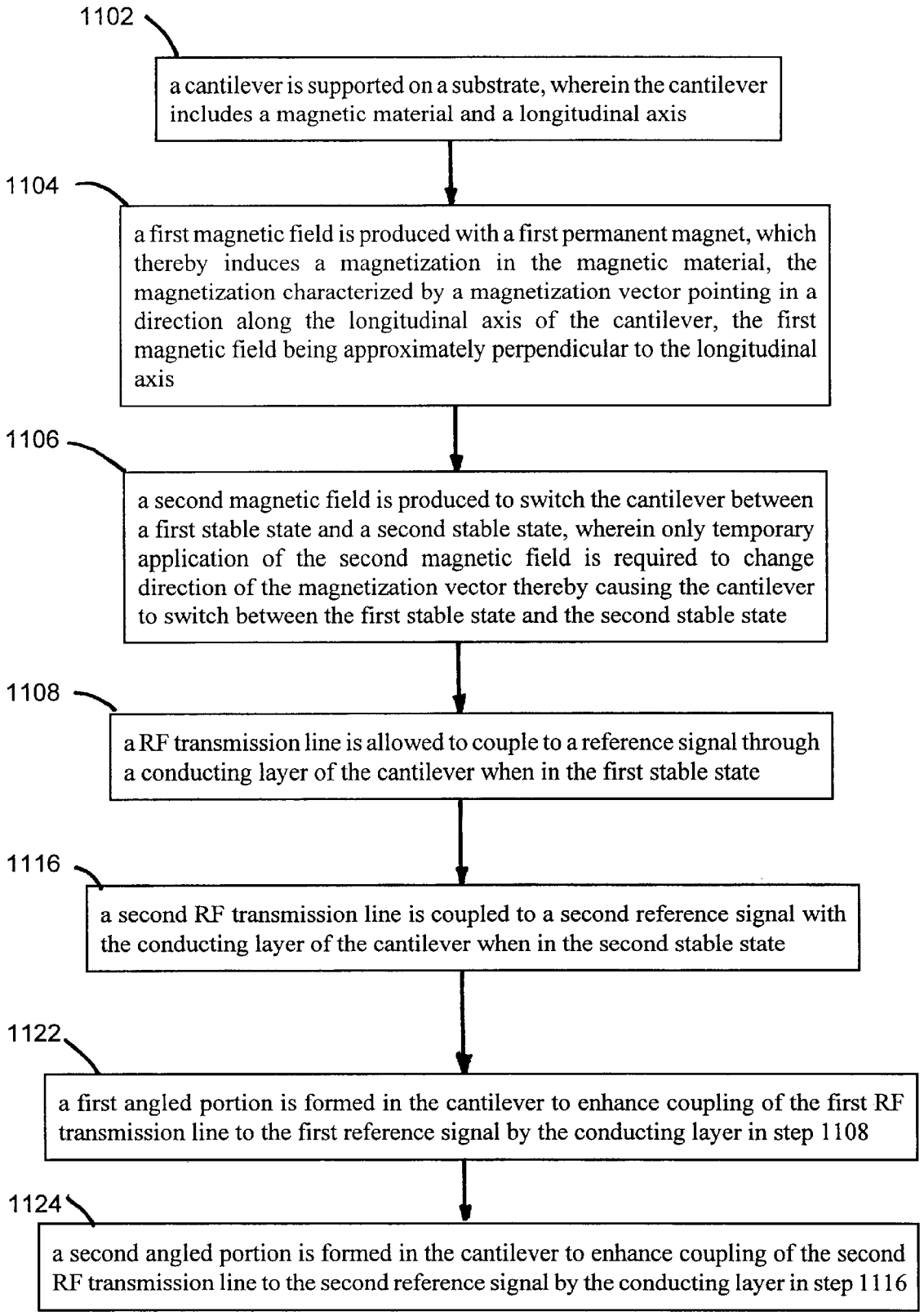

FIG. 11G shows the flowchart of FIG. 11E with an additional steps. In step 1122, a first angled portion is formed in the cantilever to enhance coupling of the first RF transmission line to the first reference signal by the conducting layer in step 1108. For example, in an alternative embodiment, cantilever portion 722 is the first angled portion of cantilever 112. Cantilever portion 722 can be pre-formed at an angle to the remainder of cantilever 112, such as the angle shown in FIG. 7B. This angle of cantilever portion 722 allows conducting layer 120 to more closely couple RF transmission line 606 to reference signal 608.

In step 1124, a second angled portion is formed in the cantilever to enhance coupling of the second RF transmission line to the second reference signal by the conducting layer in step 1116. For example, cantilever portion 720 is the second angled portion of cantilever 112. Cantilever portion 720 can be pre-formed at an angle to the remainder of cantilever 112 (not shown in FIGS. 7A–7C). The angle of cantilever portion 720 allows conducting layer 120 to more closely couple the second RF transmission line (not shown in FIGS. 7A–7C) to the second reference signal (also not shown in FIGS. 7A–7C).

Furthermore, in an embodiment, step 1108 can include the step where the second RF transmission line is decoupled from the second reference signal when in the first stable state. For example, in the first stable state, the second RF transmission line can be decoupled from the second reference signal (not shown in FIGS. 7A–7C), in a similar fashion to that shown in FIG. 7C, where first RF transmission line 606 is decoupled from reference signal 608.

Micro-Machined RF Switches with Electrostatic Actuation

FIGS. 8A–8C illustrate detailed views of micro-machined RF switch 600 with an electrostatic actuation mechanism, according to an embodiment of the present invention. FIG. 8A shows a top view, and FIGS. 8B and 8C show cross-sectional views of micro-machined RF switch 600. As shown in FIGS. 8A–8C, RF switch 600 includes substrate 104, cantilever 112, a first gate metal 812, a second gate metal 810, a first coplanar wave guide structure 832, and a second coplanar waveguide structure 830. As shown in FIGS. 8B and 8C, substrate 104 includes an optional ground plane 828.

As shown in FIG. 8A, in an embodiment, first and second coplanar wave guide structures 832 and 830 are formed on substrate 104. First coplanar wave guide structure 832 includes a first RF signal transmission line 822 positioned adjacent to a first reference signal 820. Second coplanar wave guide structure 830 includes a second RF signal transmission line 816 positioned adjacent to a second reference signal 818. In a preferred embodiment, first reference signal 820 and second reference signal 818 are ground lines, but may be coupled to other reference potential values. First and second RF signal transmission lines 822 and 816, and first and second reference signals 820 and 818 are preferably metal traces, or other structures that conduct RF signals.

A first RF signal is input to RF switch 600 at first RF input 806. A second RF signal is input to RF switch 600 at second RF input 802. The first RF signal is conducted from first RF input 806, through first co-planar wave guide structure 832, to a first RF output 808, which is a first RF signal output for RF switch 600. The second RF signal is conducted from second RF input 802, through second co-planar wave guide structure 830, to a second RF output 804, which is a second RF signal output for RF switch 600.

In the embodiment shown in FIG. 8A, first and second signal lines 838 and 840 respectively couple first and second reference signals 820 and 818 to conducting layer 120 through torsion spring 814. In alternative embodiments, first and second signal lines 838 and 840 are not required, and therefore are not present. It is understood that many variations are possible, as would be understood to persons skilled in the relevant art(s) from the teachings herein.

As shown in FIGS. 8A–8C, cantilever 112 includes bottom conducting layer 120 and an optional stiffening layer 824. Torsion spring 814 supports cantilever 112 on substrate 104, and flexes to allow cantilever 112 to rotate according to the electrostatic actuation mechanism described herein.

As illustrated in FIGS. 8A–8C, cantilever 112 can have three states. FIG. 8C shows a first state for cantilever 112, FIG. 8B shows a second state for cantilever 112, and a third state (not shown) for cantilever 112 is similar to the first state shown in FIG. 8C. In the third state, however, cantilever 112 rotates in the opposite direction. Cantilever 112 switches into the first state, which is shown in FIG. 8C, by applying a voltage to first gate metal 812 to induce an electrostatic attraction between first gate metal 812 and conducting layer 120. Similarly, cantilever 112 switches into the third state by applying a voltage to second gate metal 810 to induce an electrostatic attraction between second gate metal 810 and conducting layer 120. Cantilever 112 switches into the second state, which is shown in FIG. 8A, by removing from, or not applying the voltage to both of first and second gate metals 812 and 810. The second state for cantilever 112 is essentially a free standing state.

In FIG. 8C, a right end of cantilever 112 having cantilever portion 836 is rotated downward. Hence, a torque is exerted on cantilever 112 by the electrostatic attraction between first gate metal 812 and conducting layer 120. Conducting layer 120 on the bottom surface of cantilever 112 electrically couples (i.e., shorts) first RF signal transmission line 822 and first reference signal 820. Therefore, an RF signal cannot effectively propagate through first RF signal transmission line 822. Partial or total reflection of the RF signal from first RF input 806 is caused, and the first state for RF switch 600 is considered to be an "OFF" state for first co-planar wave guide structure 832, but is considered to be an "ON" state for second co-planar wave guide structure 830 because second RF signal transmission line 816 and second reference signal 818 are not coupled by conducting layer 120.

In the third state for RF switch 600 (not shown), a left end of cantilever 112 having cantilever portion 834 is rotated downward. Hence, a torque is exerted on cantilever 112 by the electrostatic attraction between second gate metal 810 and conducting layer 120. Conducting layer 120 on the bottom surface of cantilever 112 electrically couples (i.e., shorts) second RF signal transmission line 816 and second reference signal 818. Therefore, an RF signal cannot effectively propagate through second RF signal transmission line 816. Partial or total reflection of the RF signal from second RF input 802 is caused, and the third state for RF switch 600 is considered to be an "OFF" state for second co-planar wave guide structure 830, but is considered to be an "ON" state for first co-planar wave guide structure 832 because first RF signal transmission line 822 and first reference signal 820 are not coupled by conducting layer 120.

In FIG. 8B, neither end of cantilever 112 has substantially rotated toward substrate 104. Conducting layer 120 is not in contact with either of first and second RF signal transmission lines 822 and 816. In this state, both of first and second RF signal transmission lines 822 and 816 can transmit RF signals with minimum loss and reflection, and hence RF switch 600 is considered to be in the "ON" state for both signals.

Note that cantilever portions 836 and 834 of cantilever 112 can be angled and/or flexible. In this manner an enhanced electrical contact can be formed between first RF signal transmission line 822 and reference signal 820 in the "OFF" state shown in FIG. 8C, and between second RF signal transmission line 816 and reference signal 818 in the "OFF" state (not shown). This is further described above with regard to cantilever portion 614 shown in FIGS. 6A and 6B.

In the embodiment shown in FIGS. 8A–8C, RF switch 600 is shown as a latching single-pole double-throw switch. Note that in alternative embodiments, single-pole single-throw and other configurations for a electrostatically actuated RF switch 600 are also possible, as would be understood by persons skilled in the relevant art(s) from the teachings herein.

Figure 12A:
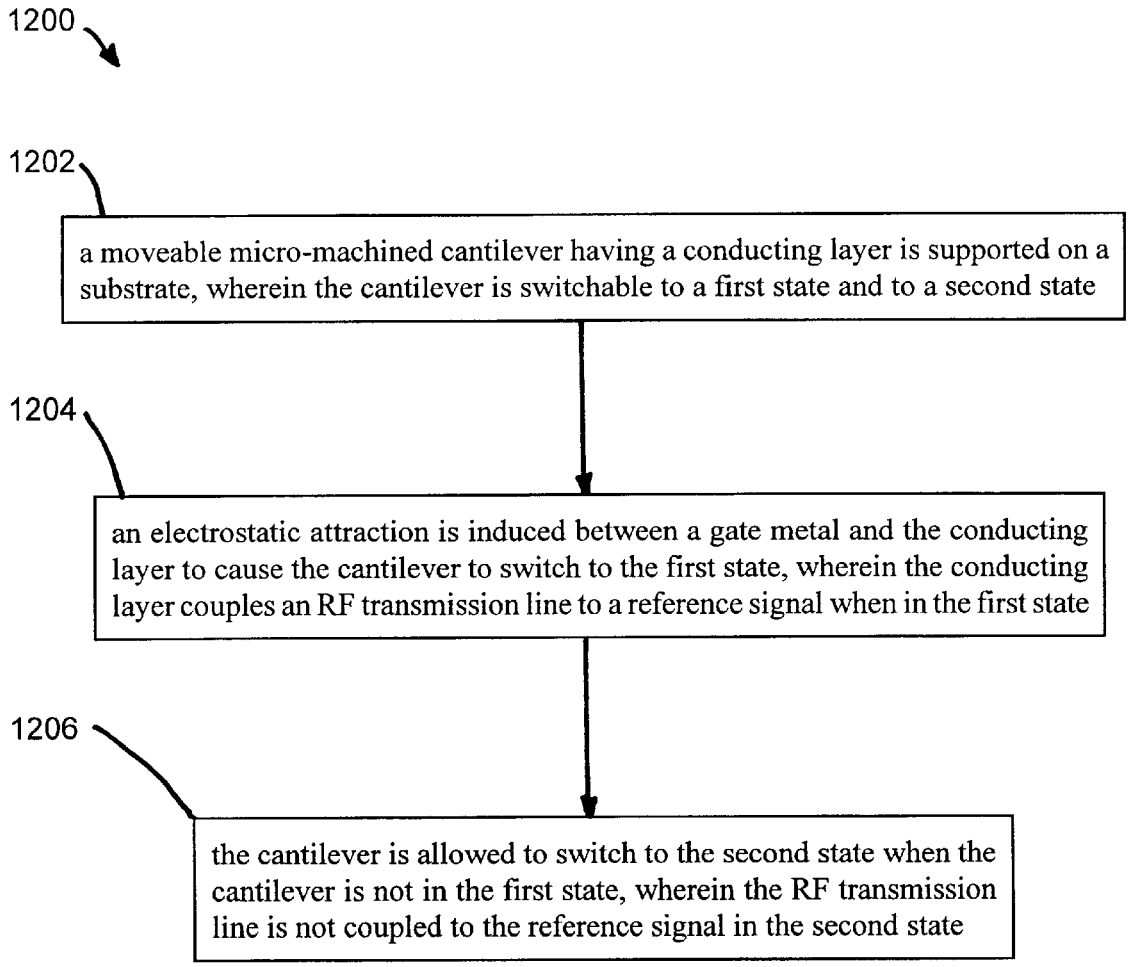

FIG. 12A shows a flowchart 1200 providing steps for operating electrostatically actuated micro-machined RF switch embodiments of the present invention. FIGS. 12B–12F show additional steps, according to further embodiments of the present invention. The steps of FIGS. 12A–12F do not necessarily have to occur in the order shown, as will be apparent to persons skilled in the relevant art(s) based on the teachings herein. Other structural embodiments will be apparent to persons skilled in the relevant art(s) based on the following discussion. These steps are described in detail below.

Flowchart 1200 begins in FIG. 12A with step 1202. In step 1202, a moveable micro-machined cantilever having a conducting layer is supported on a substrate, wherein the cantilever is switchable to a first state and to a second state. For example, the cantilever is cantilever 112 of RF switch 600, shown in FIGS. 8A–8C. Cantilever 112 is shown having conducting layer 120, and is supported on substrate 104. Cantilever 112 of FIG. 8A is switchable to a first state, shown in FIG. 8C, and a second state, shown in FIG. 8B.

In step 1204, an electrostatic attraction is induced between a gate metal and the conducting layer to cause the cantilever to switch to the first state, wherein the conducting layer couples an RF transmission line to a reference signal when in the first state. For example, the electrostatic attraction is induced between first gate metal 812 and conducting layer 120, which causes cantilever 112 to switch to the first state shown in FIG. 8C. In this first state, conducting layer 120 couples first RF transmission line 822 to reference signal 820.

In step 1206, the cantilever is allowed to switch to the second state when the cantilever is not in the first state, wherein the RF transmission line is not coupled to the reference signal in the second state. For example, cantilever 112 is allowed to switch to the second state shown in FIG. 8B when cantilever 112 is not in the first state shown in FIG. 8C. In the second state shown in FIG. 8B, first RF transmission line 822 is not coupled to first reference signal 820.

In an embodiment, step 1204 includes the step where a voltage is applied to the gate metal to produce the electrostatic attraction between the gate metal and the conducting layer. For example, a voltage can be applied to first gate metal 812 to produce the electrostatic attraction between first gate metal 812 and conducting layer 120. In an embodiment, step 1206 includes the step where the voltage is removed from the gate metal to remove the electrostatic attraction between the gate metal and the conducting layer. For example, the voltage can be removed from first gate metal 812 to sufficiently reduce or totally eliminate the electrostatic attraction between first gate metal 812 and conducting layer 120.

In an embodiment, step 1206 includes the step where the cantilever is allowed to position itself so that the conducting layer does not couple the RF transmission line to the reference signal. For example, because there is no electrostatic attraction between first gate metal 812 and conducting layer 120, cantilever 112 is allowed to position itself (due to tension in torsion spring 814, for instance) so that conducting layer 120 does not couple first RF transmission line 822 to reference signal 820.

In an embodiment, step 1202 includes the step where the cantilever is supported on a torsion spring attached to the substrate, wherein the torsion spring flexes to allow the cantilever to rotate. For example, the torsion spring is torsion spring 814 shown in FIG. 8A, which supports cantilever 1122 on substrate 104. Torsion spring 814 flexes to allow cantilever 112 to rotate right and left.

Figure 12B:
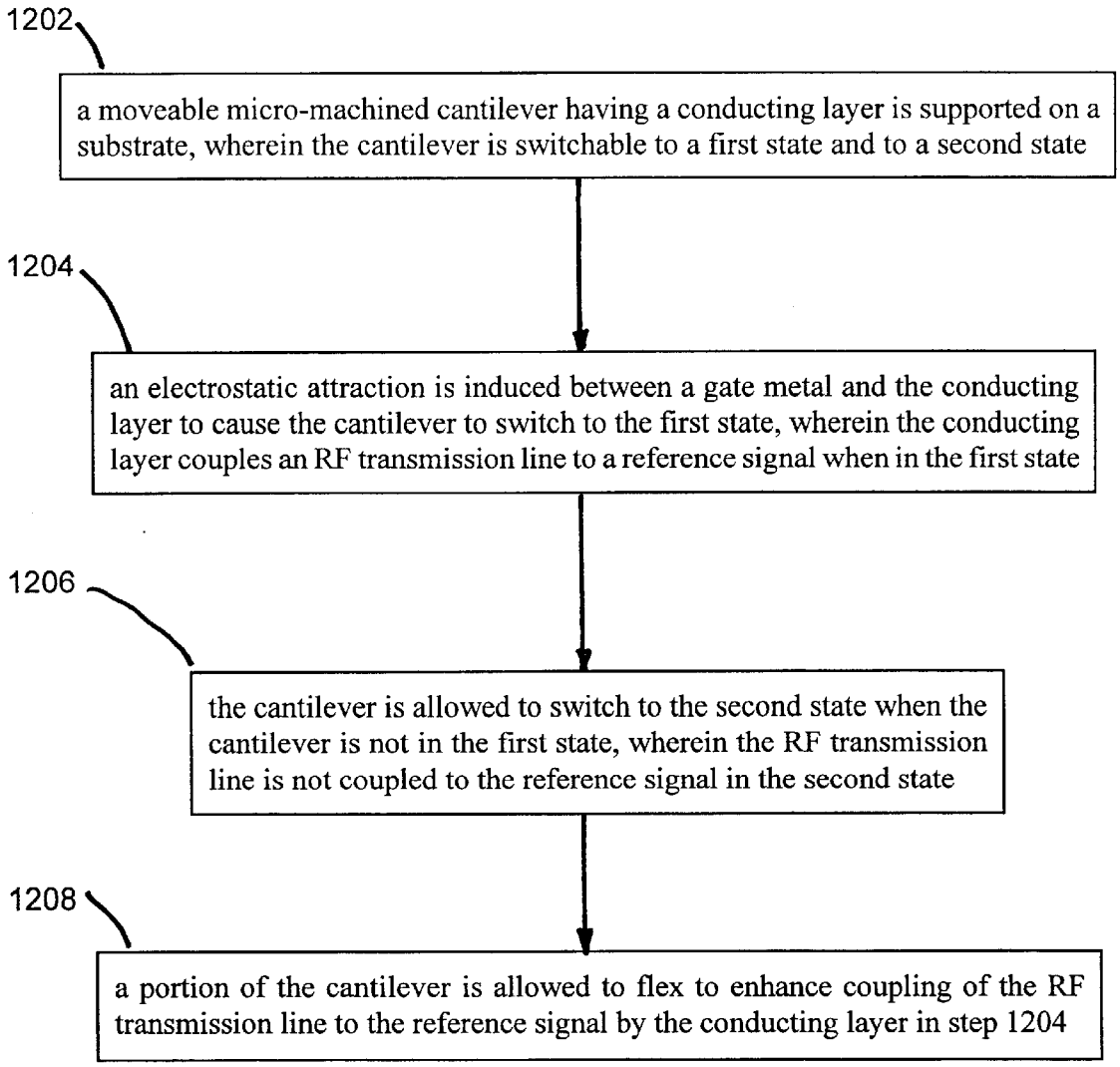

FIG. 12B shows flowchart 1200 with an additional step 1208. In step 1208, a portion of the cantilever is allowed to flex to enhance coupling of the RF transmission line to the reference signal by the conducting layer in step 1204. For example, the portion of the cantilever that is allowed to flex is cantilever portion 836, shown in FIG. 8C. Cantilever portion 836 flexes to allow conducting layer 120 to more closely couple RF transmission line 822 to reference signal 820.

Figure 12C:
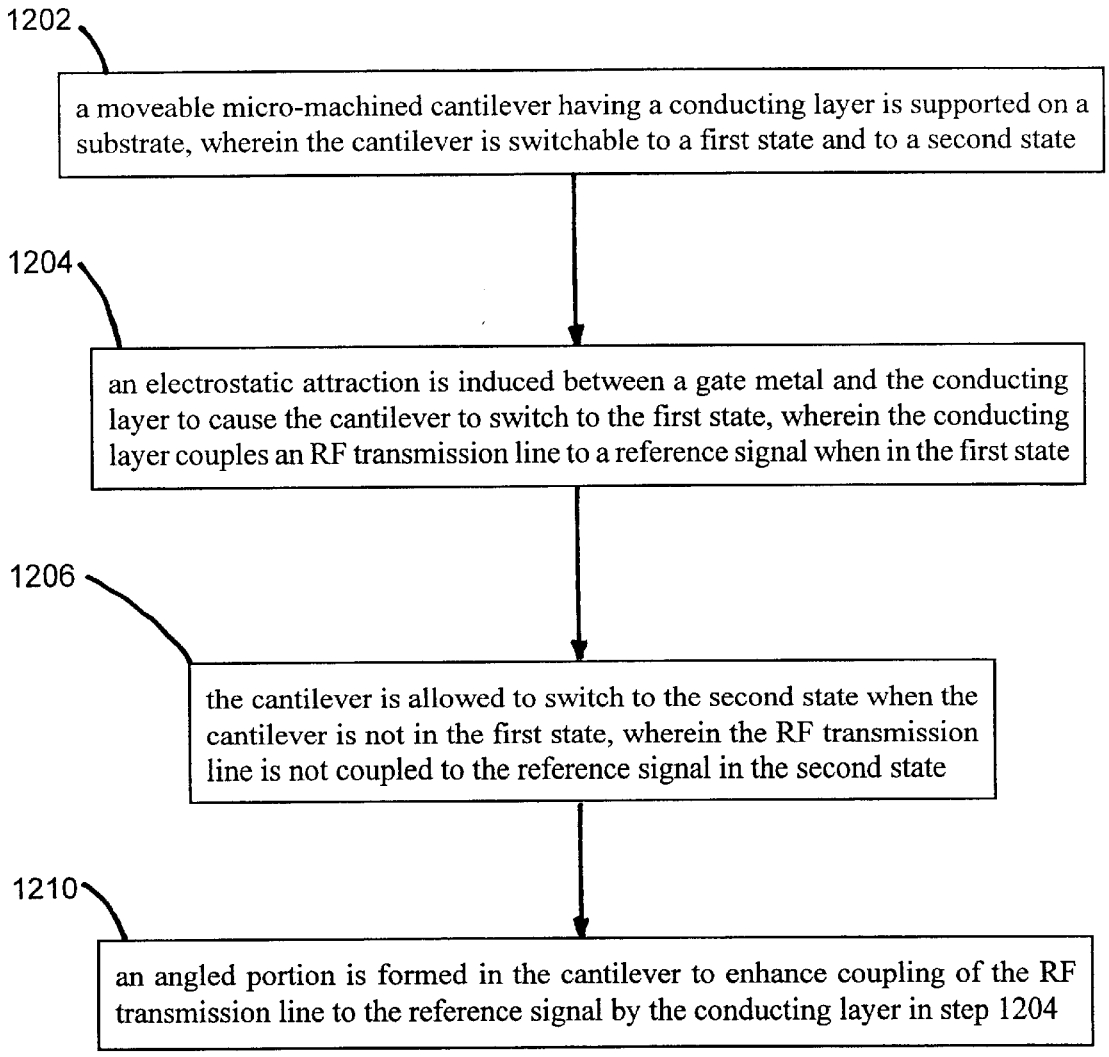

FIG. 12C shows flowchart 1200 with an additional step 1210. In step 1210, an angled portion is formed in the cantilever to enhance coupling of the RF transmission line to the reference signal by the conducting layer in step 1204. For example, in an alternative embodiment, cantilever portion 836 is an angled portion of cantilever 112. Cantilever portion 836 can be pre-formed at an angle to the remainder of cantilever 112, such as the angle shown in FIG. 8C. This angle of cantilever portion 836 allows conducting layer 120 to more closely couple RF transmission line 822 to reference signal 820.

Figure 12D:
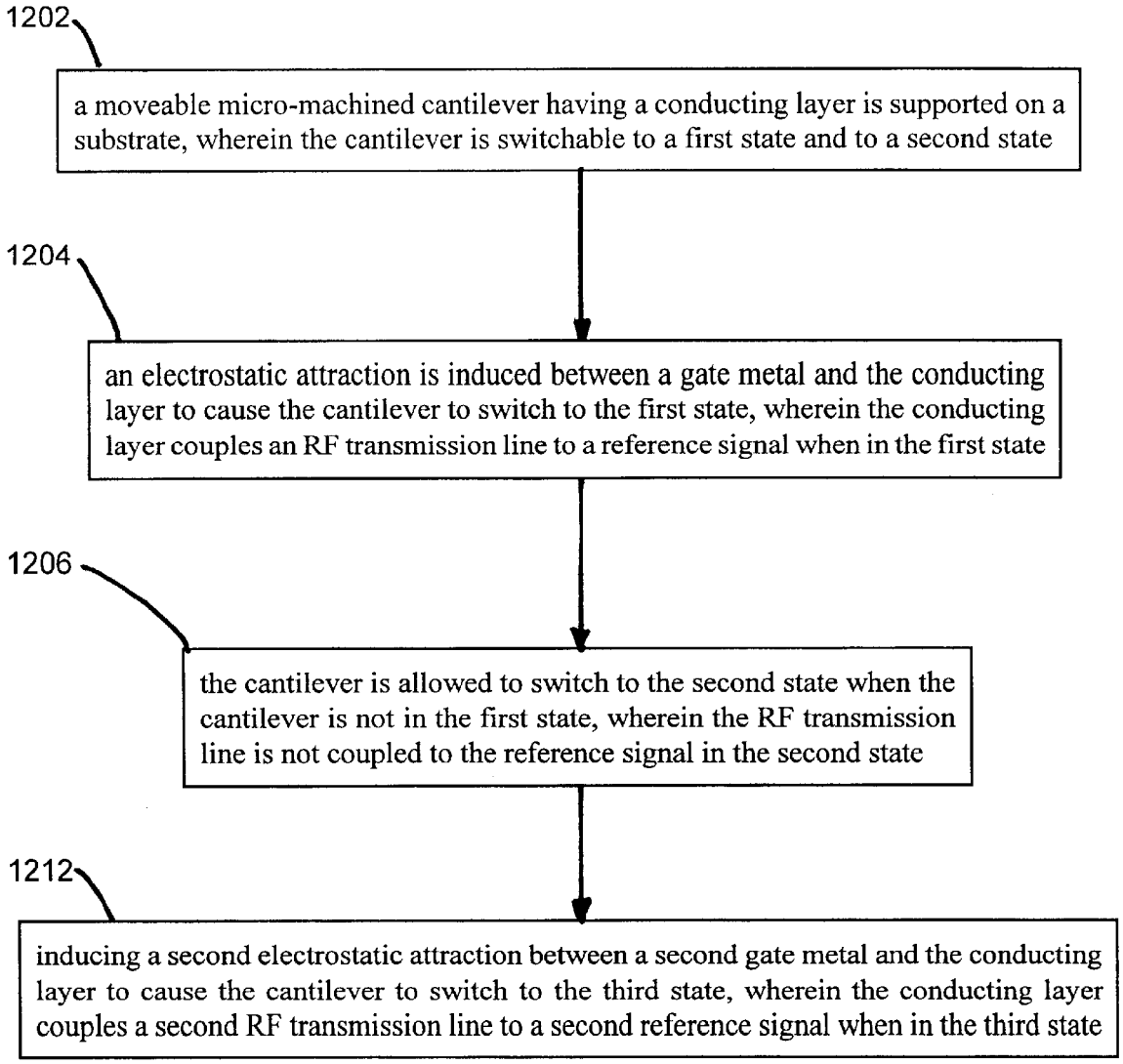

In an embodiment, the cantilever is switchable to a third state. FIG. 12D shows flowchart 1200 with an additional step 1212. In step 1212, a second electrostatic attraction is induced between a second gate metal and the conducting layer to cause the cantilever to switch to the third state, wherein the conducting layer couples a second RF transmission line to a second reference signal when in the third state. For example, a second electrostatic attraction can be induced between second gate metal 810 and conducting layer 120, which causes cantilever 112 to switch to the third state described above (not shown). In the third state, conducting layer 120 couples second RF transmission line 818 to second reference signal 818.

Furthermore, in an embodiment, step 1204 includes the step where a voltage is applied to the first gate metal to produce the first electrostatic attraction between the first gate metal and the conducting layer. For example, a voltage can be applied to first gate metal 812 to produce the first electrostatic attraction between first gate metal 812 and conducting layer 120.

In an embodiment, step 1208 includes the step where a voltage is applied to the second gate metal to produce the second electrostatic attraction between the second gate metal and the conducting layer. For example, a voltage can be applied to second gate metal 810 to produce the second electrostatic attraction between second gate metal 810 and conducting layer 120.

In an embodiment, step 1204 includes the step where the cantilever is caused to rotate in a first direction to couple the first RF transmission line to the first reference signal with the conducting layer. Furthermore, in an embodiment, step 1208 includes the step where the cantilever is caused to rotate in a second direction to couple the second RF transmission line to the second reference signal with the conducting layer. For example, as shown in FIG. 8C, cantilever 112 is caused to rotate right, or clockwise, to couple first RF transmission line 822 to first reference signal 820. Cantilever 112 is caused to rotate left, or counterclockwise, to couple second RF transmission line 816 to second reference signal 822. Note that these directions are relative, and are merely provided for illustrative purposes.

In an embodiment, step 1206 includes the step where the cantilever is allowed to position itself so that the conducting layer does not couple the first RF transmission line to the first reference signal, and the conducting layer does not couple the second RF transmission line to the second reference signal. For example, in the second state, because there is no electrostatic attraction between first gate metal 812 and conducting layer 120, or between second gate metal 812 and conducting layer 120, cantilever 112 is allowed to position itself (due to tension in torsion spring 814, for instance) so that conducting layer 120 does not couple first RF transmission line 822 to reference signal 820, and does not couple second RF transmission line 816 to second reference signal 818.

Figure 12E:
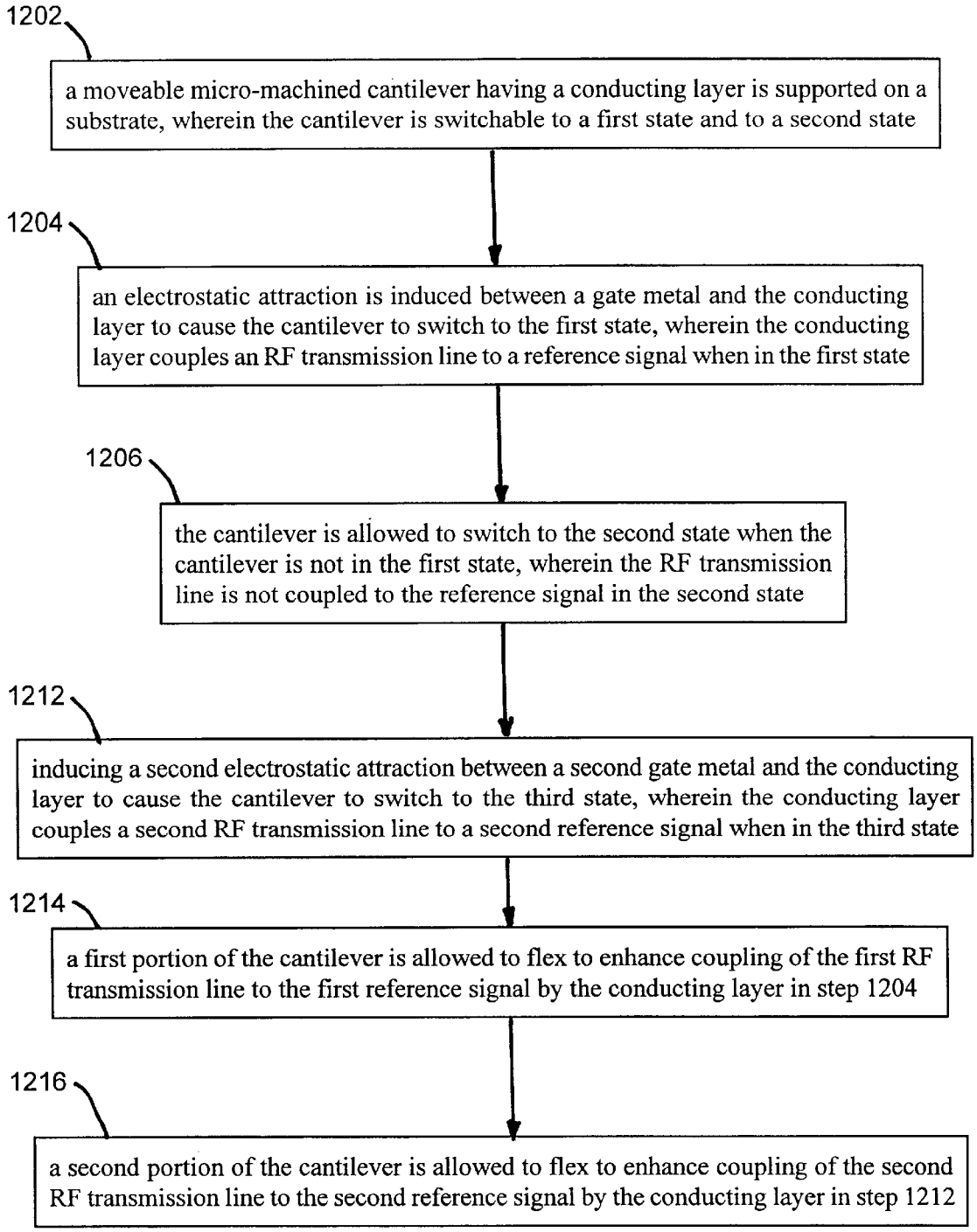

FIG. 12E shows the flowchart of FIG. 12D with additional steps. In step 1214, a first portion of the cantilever is allowed to flex to enhance coupling of the first RF transmission line to the first reference signal by the conducting layer in step 1204. For example, the first portion of the cantilever that is allowed to flex is cantilever portion 836, shown in FIG. 8C.

Cantilever portion 836 can flex to allow conducting layer 120 to more closely couple first RF transmission line 822 to first reference signal 820.

In step 1216, a second portion of the cantilever is allowed to flex to enhance coupling of the second RF transmission line to the second reference signal by the conducting layer in step 1212. For example, the portion of the cantilever that is allowed to flex is cantilever portion 834. Cantilever portion 834 can flex (not shown) to allow conducting layer 120 to more closely couple second RF transmission line 816 to second reference signal 818.

Figure 12F:
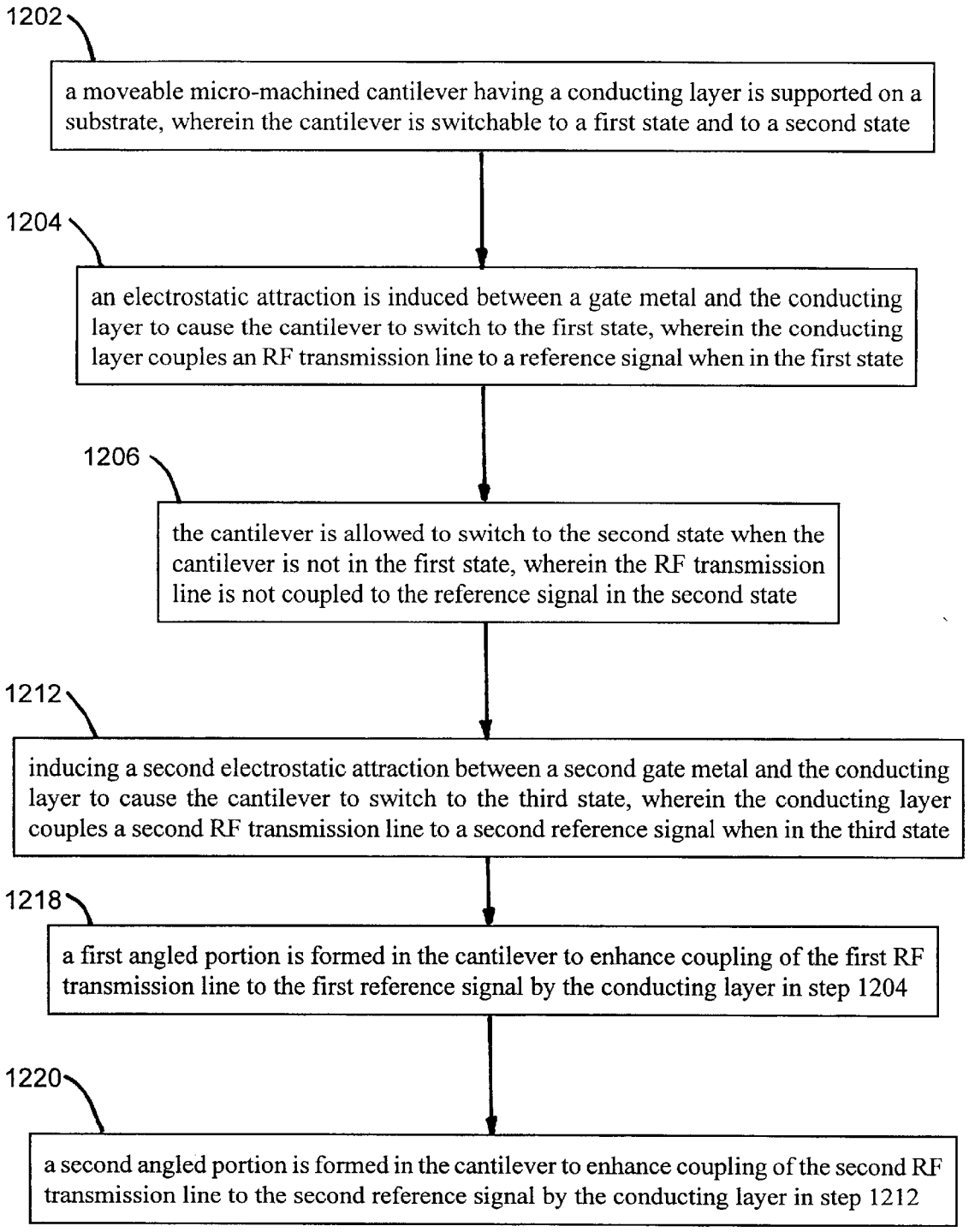

FIG. 12F shows the flowchart of FIG. 12D with additional steps. In step 1218, a first angled portion is formed in the cantilever to enhance coupling of the first RF transmission line to the first reference signal by the conducting layer in step 1204. For example, in an alternative embodiment, cantilever portion 836 is the first angled portion of cantilever 112. Cantilever portion 836 can be pre-formed at an angle to the remainder of cantilever 112, such as the angle shown in FIG. 8C. This angle of cantilever portion 836 allows conducting layer 120 to more closely couple RF transmission line 822 to reference signal 820.

In step 1220, a second angled portion is formed in the cantilever to enhance coupling of the second RF transmission line to the second reference signal by the conducting layer in step 1212. For example, cantilever portion 834 is the second angled portion of cantilever 112. Cantilever portion 834 can be pre-formed at an angle to the remainder of cantilever 112 (not shown in FIGS. 8A–8C). The angle of cantilever portion 834 allows conducting layer 120 to more closely couple second RF transmission line 816 to second reference signal 818.

Example Micro-Machined RF Switch Simulation Results

FIG. 9B illustrates results of a simulation conducted by ANSOFT SERENADE™ and HARMONICA™ software for a schematic equivalent circuit diagram shown in FIG. 9A of a micro-machined RF switch of the present invention. In FIG. 9A, the RF switch is in the "ON" state. The results of the S11 and S21 parameters (0 to 5 GHz) are shown in FIG. 9B. MS coupled lines are used to simulate RF signal transmission lines. Example dimensions are shown in the equivalent circuit of FIG. 9A, and are listed as follows: width w=100 mm, separation s=50 mm, and length p=500 mm on each side. The RF switch substrate is 500 mm thick with a relative dielectric constant of 13. As shown in FIG. 9B, at 2 GHz, S11=−44.16, and S21=−0.012, which is an excellent insertion loss value. Note that the resistor (0.1 W) is deactivated in this simulation, as shown in FIG. 9A.

FIG. 10B illustrates results of a simulation conducted by ANSOFT SERENADE™ and HARMONICA™ software for a schematic equivalent circuit diagram shown in FIG. 10A of a micro-machined RF switch of the present invention. In FIG. 10A, the RF switch is in the "OFF" state. The results of the S11 and S21 parameters (0 to 5 GHz) are shown in FIG. 10B. A resistor of 0.1 W is used to simulate the connection (short) between the RF signal transmission line and ground line(s) when the cantilever conducting layer is down and coupling the two together. All other device parameters are the same as those provided for the simulation of FIGS. 9A–9B. At 2 GHz, S11=−0.05, and S21=−33.44, which is adequate isolation for many applications.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A micro-machined radio frequency (RF) switch, comprising:

a substrate;

a moveable micro-machined cantilever supported by said substrate and having a magnetic material and a longitudinal axis, wherein said cantilever has a conducting layer;

a first permanent magnet producing a first magnetic field, which induces a magnetization in said magnetic material, said magnetization characterized by a magnetization vector pointing in a direction along said longitudinal axis of said cantilever, wherein said first magnetic field is approximately perpendicular to said longitudinal axis; and an electromagnet producing a second magnetic field to switch said cantilever between a first stable state and a second stable state, wherein a temporary current through said electromagnet produces said second magnetic field such that a component of said second magnetic field parallel to said longitudinal axis changes direction of said magnetization vector thereby causing said movable element to switch between said first stable state and said second stable state;

wherein in said first stable state, said conducting layer couples a RF transmission line to a reference signal; and wherein in said second stable state, said conducting layer does not couple the RF transmission line to the reference signal.

2. The micro-machined RF switch of claim 1, wherein said reference signal is a ground line.

3. The micro-machined RF switch of claim 2, wherein in said first stable state, a portion of said conducting layer couples said RF transmission line to said ground line.

4. The micro-machined RF switch of claim 2, wherein said ground line and said RF transmission line are included in a coplanar wave guide structure.

5. The micro-machined RF switch of claim 1, wherein said cantilever flexes to enhance coupling of said RF transmission line to said reference signal by said conducting layer.

6. The micro-machined RF switch of claim 1, wherein said cantilever includes an angled portion to enhance coupling of said RF transmission line to said reference signal by said conducting layer.

7. The micro-machined RF switch of claim 1, further comprising a torsion spring that supports said cantilever on said substrate, wherein said torsion spring flexes to allow said cantilever to move between said first stable state and said second stable state.

8. The micro-machined RF switch of claim 1, further comprising:

a dielectric layer formed over said electromagnet on a surface of said substrate, wherein said RF transmission line is formed on said dielectric layer.

9. The micro-machined RF switch of claim 1, wherein said magnetic material forms a first soft magnetic layer of said cantilever, wherein said cantilever includes a second soft magnetic layer.

10. The micro-machined RF switch of claim 1, further comprising:

a second permanent magnet producing said first magnetic field with said first permanent magnet.

11. The micro-machined RF switch of claim 10, wherein said cantilever is located between said first permanent magnet and said second permanent magnet.

12. The micro-machined RF switch of claim 1, wherein in said second stable state, said conducting layer couples a second RF transmission line to a second reference signal.

13. The micro-machined RF switch of claim 12, wherein in said first stable state, a first portion of said conducting layer connects said first RF transmission line to the first reference signal, and wherein in said second stable state, a second portion of said conducting layer connects said second RF transmission line to said second reference signal.

14. The micro-machined RF switch of claim 12, wherein a first portion of said cantilever flexes to enhance coupling of said first RF transmission line to said first reference signal by said conducting layer, and a second portion of said cantilever flexes to enhance coupling of said second RF transmission line to said second reference signal by said conducting layer.

15. The micro-machined RF switch of claim 12, wherein said cantilever includes a first angled portion to enhance coupling of said first RF transmission line to said first reference signal by said conducting layer, and said cantilever includes a second angled portion to enhance coupling of said second RF transmission line to said second reference signal by said conducting layer.

16. A micro-machined radio frequency (RF) switch, comprising:

a substrate;

a moveable micro-machined cantilever supported by said substrate and having a conducting layer, wherein said cantilever is switchable to a first state and a second state; and a gate metal formed on a surface of said substrate proximate to said conducting layer, wherein a voltage applied to said gate metal produces an electrostatic attraction between said gate metal and said conducting layer thereby causing said cantilever to switch to said first stable state;

wherein in said first state, said conducting layer couples a RF transmission line to a reference signal; and wherein in said second state, said conducting layer is decoupled from the first RF transmission line.

17. The micro-machined RF switch of claim 16, wherein said cantilever includes a stiffening layer.

18. The micro-machined RF switch of claim 16, wherein said reference signal is a ground line.

19. The micro-machined RF switch of claim 18, further comprising:

a torsion spring that supports said cantilever on said substrate, wherein said torsion spring flexes to allow said cantilever to move; and wherein said ground line is coupled to said conducting layer through said torsion spring.

20. The micro-machined RF switch of claim 16, wherein said substrate includes a ground plane.

21. The micro-machined RF switch of claim 16, wherein said cantilever flexes to enhance coupling of said RF transmission line to said reference signal by said conducting layer.

22. The micro-machined RF switch of claim 16, wherein said cantilever includes an angled portion to enhance coupling of said RF transmission line to said reference signal by said conducting layer.

23. The micro-machined RF switch of claim 16, further comprising:

a torsion spring that supports said cantilever on said substrate, wherein said torsion spring flexes to allow said cantilever to move.

24. The micro-machined RF switch of claim 23, further comprising:

a second gate metal formed on a surface of said substrate proximate to said conducting layer, on a side of said torsion spring opposite said first gate metal, wherein a voltage applied to said second gate metal produces an electrostatic attraction between said second gate metal and said conducting layer thereby causing said cantilever to switch to a third state wherein in said third state, said conducting layer couples a second RF transmission line to a second reference signal; and wherein in said second state, said conducting layer is decoupled from the first and second RF transmission lines.

25. The micro-machined RF switch of claim 24, wherein said second reference signal is a ground line.

26. The micro-machined RF switch of claim 24, wherein said first reference signal is a first ground line and said second reference signal is a second ground line.

27. The micro-machined RF switch of claim 26, wherein in said first state, a first portion of said conducting layer connects said first RF transmission line to said first ground line, and wherein in said second state, a second portion of said conducting layer connects said second RF transmission line to said second ground line.

28. The micro-machined RF switch of claim 27, wherein said first ground line and said first RF transmission line are included in a first coplanar wave guide structure, and wherein said second ground line and said second RF transmission line are included in a second coplanar wave guide structure.

29. The micro-machined RF switch of claim 27, wherein said first ground line and said second ground line are coupled to said conducting layer through said torsion spring.

30. The micro-machined RF switch of claim 24, wherein a first portion of said cantilever flexes to enhance coupling of said first RF transmission line to said first reference signal by said conducting layer, and a second portion of said cantilever flexes to enhance coupling of said second RF transmission line to said second reference signal by said conducting layer.

31. The micro-machined RF switch of claim 24, wherein said cantilever includes a first angled portion to enhance coupling of said first RF transmission line to said first reference signal by said conducting layer, and said cantilever includes a second angled portion to enhance coupling of said second RF transmission line to said second reference signal by said conducting layer.

32. A method for operating a micro-machined magnetic radio frequency (RF) switch, comprising the steps of:

(A) supporting a cantilever on a substrate, wherein the cantilever includes a magnetic material and a longitudinal axis;

(B) producing a first magnetic field with a first permanent magnet, which thereby induces a magnetization in the magnetic material, the magnetization characterized by a magnetization vector pointing in a direction along the longitudinal axis of the cantilever, the first magnetic field being approximately perpendicular to the longitudinal axis;

(C) producing a second magnetic field to switch the cantilever between a first stable state and a second stable state, wherein only temporary application of the second magnetic field is required to change direction of the magnetization vector thereby causing the movable element to switch between the first stable state and the second stable state; and (D) allowing a RF transmission line to couple to a reference signal through a conducting layer of the cantilever when in the first stable state.

33. The method of claim 32, further comprising the step of:

(E) decoupling the RF transmission line from the reference signal when in the second stable state.

34. The method of claim 32, wherein step (C) includes the step of:

producing the second magnetic field with an electromagnet.

35. The method of claim 32, wherein step (A) includes the step of:

producing the first magnetic field with the first permanent magnet and a second permanent magnet, wherein the cantilever is located between the first permanent magnet and the second permanent magnet.

36. The method of claim 32, further comprising the step of:

(E) allowing a portion of the cantilever to flex to enhance coupling of the RF transmission line to the reference signal by the conducting layer in step (D).

37. The method of claim 30, further comprising the step of:

(E) forming an angled portion in the cantilever to enhance coupling of the RF transmission line to the reference signal by the conducting layer in step (D).

38. The method of claim 32, further comprising the step of:

(E) coupling a second RF transmission line to a second reference signal with the conducting layer of the cantilever when in the second stable state.

39. The method of claim 38, further comprising the steps of:

(F) allowing a first portion of the cantilever to flex to enhance coupling of the first RF transmission line to the first reference signal by the conducting layer in step (D); and (G) allowing a second portion of the cantilever to flex to enhance coupling of the second RF transmission line to the second reference signal by the conducting layer in step (E).

40. The method of claim 38, further comprising the steps of:

(F) forming a first angled portion in the cantilever to enhance coupling of the first RF transmission line to the first reference signal by the conducting layer in step (D); and (G) forming a second angled portion in the cantilever to enhance coupling of the second RF transmission line to the second reference signal by the conducting layer in step (E).

41. The method of claim 38, wherein step (D) comprises the step of:

decoupling the second RF transmission line from the second reference signal when in the first stable state.

42. A method for operating a micro-machined radio frequency (RF) switch, comprising the steps of:

(A) supporting a moveable micro-machined cantilever having a conducting layer on a substrate, wherein the cantilever is switchable to a first state and to a second state;

(B) inducing an electrostatic attraction between a gate metal and the conducting layer to cause the cantilever to switch to the first state, wherein the conducting layer couples an RF transmission line to a reference signal when in the first state; and (C) allowing the cantilever to switch to the second state when the cantilever is not in the first state, wherein the RF transmission line is not coupled to the reference signal in the second state.

43. The method of claim 42, wherein step (B) includes the step of:

applying a voltage to the gate metal to produce the electrostatic attraction between the gate metal and the conducting layer.

44. The method of claim 43, wherein step (C) includes the step of:

removing the voltage from the gate metal to remove the electrostatic attraction between the gate metal and the conducting layer.

45. The method of claim 42, wherein step (C) includes the step of:

allowing the cantilever to position itself so that the conducting layer does not couple the RF transmission line to the reference signal.

46. The method of claim 42, wherein step (A) includes the step of:

supporting the cantilever on a torsion spring attached to the substrate, wherein the torsion spring flexes to allow the cantilever to rotate.

47. The method of claim 42, further comprising the step of:

(D) allowing a portion of the cantilever to flex to enhance coupling of the RF transmission line to the reference signal by the conducting layer in step (B).

48. The method of claim 42, further comprising the step of:

(D) forming an angled portion in the cantilever to enhance coupling of the RF transmission line to the reference signal by the conducting layer in step (B).

49. The method of claim 42, wherein the cantilever is switchable to a third state, further comprising the step of:

(D) inducing a second electrostatic attraction between a second gate metal and the conducting layer to cause the cantilever to switch to the third state, wherein the conducting layer couples a second RF transmission line to a second reference signal when in the third state;

wherein step (C) includes the step of:

allowing the cantilever to switch to the second state when the cantilever is not in the first state and is not in the third state, wherein the first RF transmission line is not coupled to the first reference signal and the second RF transmission line is not coupled to the second reference signal in the second state.

50. The method of claim 49, wherein step (B) includes the step of:

applying a voltage to the first gate metal to produce the first electrostatic attraction between the first gate metal and the conducting layer.

51. The method of claim 49, wherein step (D) includes the step of:

applying a voltage to the second gate metal to produce the second electrostatic attraction between the second gate metal and the conducting layer.

52. The method of claim 49, wherein step (B) includes the step of:

causing the cantilever to rotate in a first direction to couple the first RF transmission line to the first reference signal with the conducting layer.

53. The method of claim 52, wherein step (D) includes the step of:

causing the cantilever to rotate in a second direction to couple the second RF transmission line to the second reference signal with the conducting layer.

54. The method of claim 49, wherein step (C) includes the step of:

allowing the cantilever to position itself so that the conducting layer does not couple the first RF transmission line to the first reference signal, and the conducting layer does not couple the second RF transmission line to the second reference signal.

55. The method of claim 49, further comprising the steps of:

(E) allowing a first portion of the cantilever to flex to enhance coupling of the first RF transmission line to the first reference signal by the conducting layer in step (B); and (F) allowing a second portion of the cantilever to flex to enhance coupling of the second RF transmission line to the second reference signal by the conducting layer in step (D).

56. The method of claim 49, further comprising the steps of:

(E) forming a first angled portion in the cantilever to enhance coupling of the first RF transmission line to the first reference signal by the conducting layer in step (B); and (F) forming a second angled portion in the cantilever to enhance coupling of the second RF transmission line to the second reference signal by the conducting layer in step (D).

* * * * *

UNITED STATES PATENT AND TRADEMARK OFFICE

CERTIFICATE OF CORRECTION

PATENT NO. : 6,639,493 B2
DATED : October 28, 2003
INVENTOR(S) : Shen et al.

It is certified that error appears in the above-identified patent and that said Letters Patent is hereby corrected as shown below:

Column 1,
Line 3, after the title , insert the following:
-- Partial funding for the development of this invention was provided by the U.S. Government Grant Number Air Force F29601-00-C-0033, with the United States Air Force; and the United States Government may own certain rights to this invention. --

Signed and Sealed this

Sixth Day of July, 2004

JON W. DUDAS
*Acting Director of the United States Patent and Trademark Office*